US010960392B2

(12) United States Patent
De Lange et al.

(10) Patent No.: US 10,960,392 B2
(45) Date of Patent: Mar. 30, 2021

(54) DEVICE AND METHOD FOR ANALYSING LIQUID SAMPLES

(71) Applicant: ETH Zurich, Zurich (CH)

(72) Inventors: Victoria De Lange, Dubendorf (CH); Janos Vörös, Zurich (CH); Marco Habegger, Barau (CH); Marco Schmidt, Brig (CH)

(73) Assignee: ETH ZURICH, Zurich (CH)

( * ) Notice: Subject to any disclaimer, the term of this patent is extended or adjusted under 35 U.S.C. 154(b) by 418 days.

(21) Appl. No.: 15/757,995

(22) PCT Filed: Aug. 15, 2016

(86) PCT No.: PCT/EP2016/069349
§ 371 (c)(1),
(2) Date: Mar. 7, 2018

(87) PCT Pub. No.: WO2017/032632
PCT Pub. Date: Mar. 2, 2017

(65) Prior Publication Data

US 2018/0250671 A1 Sep. 6, 2018

(30) Foreign Application Priority Data

Aug. 25, 2015 (EP) ..... 15182428

(51) Int. Cl.
*B01L 3/00* (2006.01)

(52) U.S. Cl.
CPC ..... *B01L 3/50255* (2013.01); *B01L 3/5027* (2013.01); *B01L 3/502715* (2013.01);
(Continued)

(58) Field of Classification Search
CPC ..... B01L 3/50255; B01L 3/5027; B01L 3/502715; B01L 2400/0406;
(Continued)

(56) References Cited

U.S. PATENT DOCUMENTS

2014/0220606 A1 8/2014 Puntambekar et al.

FOREIGN PATENT DOCUMENTS

WO 2014053237 4/2014
WO WO-2014053237 A1 * 4/2014 ..... B01L 3/5027

OTHER PUBLICATIONS

Riegger et al, "Adhesive bonding of microfluidic chips: influence of process parameters" J. Micromech. Microeng. 20 (2010) 087003, pp. 1-5. (Year: 2010).*

(Continued)

*Primary Examiner* — Dennis White
(74) *Attorney, Agent, or Firm* — JMB Davis Ben-David

(57) ABSTRACT

The invention relates to a device (1), a method, and a kit for analysing liquid samples. The device (1) comprises a sample layer (111) having a plurality of liquid permeable test sites (112) separated by a liquid impermeable barrier region (113), and an inlet part (2) comprising a plurality of inlet channels (211), which lead to respective test sites (112) of the sample layer (111), such that a flow connection between said inlet channels (211) and said respective test sites (112) is established or can be established, wherein said inlet channels (211) comprise first openings (218) and second openings (219), wherein a second surface area defined by the positions of said second openings (219) is smaller than a first surface area defined by the positions of said first openings (218) The invention further relates to a method for functionalizing a sample layer (111).

19 Claims, 15 Drawing Sheets

(52) U.S. Cl.
CPC . *B01L 2200/021* (2013.01); *B01L 2200/0631* (2013.01); *B01L 2200/0689* (2013.01); *B01L 2200/12* (2013.01); *B01L 2300/0645* (2013.01); *B01L 2300/0654* (2013.01); *B01L 2300/0681* (2013.01); *B01L 2300/087* (2013.01); *B01L 2300/0819* (2013.01); *B01L 2300/0861* (2013.01); *B01L 2400/0406* (2013.01); *B01L 2400/0409* (2013.01); *B01L 2400/0487* (2013.01)

(58) Field of Classification Search
CPC ..... B01L 2300/0645; B01L 2400/0487; B01L 2200/0689; B01L 2200/021; B01L 2400/0409; B01L 2300/0819; B01L 2300/0654; B01L 2300/087; B01L 2200/0631; B01L 2200/12; B01L 2300/0681; B01L 2300/0861
See application file for complete search history.

(56) References Cited

OTHER PUBLICATIONS

Lenk et al,"Delay Valving in Capillary Driven Devices Based on Dissolvable Thin Films" 18th International Conference on Miniaturized Systems for Chemistry and Life Sciences, Oct. 26-30, 2014, San Antonio, Texas, pp. 216-218 (Year: 2014).*

Tak For Yu et al, Rapid, automated, parallel quantitative immunoassays using highly integrated microfluidics and AlphaLISA, Scientific Reports vol. 5, Article No. 11339 (2015) pp. 1-12 (Year: 2015).*

* cited by examiner

A

5 µl of blood + 10 µl PBS

5 µl of blood

B

A

B

DEVICE AND METHOD FOR ANALYSING LIQUID SAMPLES

CROSS-REFERENCE TO RELATED APPLICATIONS

This is the U.S. National Stage of International Application No. PCT/EP2016/069349 filed on Aug. 15, 2016, which was published in English under PCT Article 21(2), and which in turn claims the priority of European Patent Application no. 15182428.1 filed Aug. 25, 2015.

The invention relates to a device for analysing liquid samples, particularly for analysis of protein containing samples by immunofiltration.

BACKGROUND OF THE INVENTION

Protein microarrays consist of spatially addressable test sites with micro to nano dimensions for highly multiplexed sensing. Miniature, planar test sites have several advantages (e.g. they are insensitive to sample volume errors, have high signal-to-noise ratios and high throughput), but are not well suited for analysing dilute samples because of the long incubation times needed to reach equilibrium (Ekins & Chu, 1991, *Clin Chem* 37(11), 1955-1967; Xu & Bao, 2003, *Anal Chem* 75(20), 5345-5351).

In contrast, immunofiltration assays can rapidly detect low amounts of analyte by flowing samples vertically through membranes dense with capture probes. However, relatively large spot diameters and issues isolating samples mean that these systems lack the high signal-to-noise ratio and throughput of microarrays (Valkirs, G. E., Barton, R., 1985, *Clin Chem* 31(9), 1427-1431).

Microfiltration devices are commercially available in a 96-well format as enzyme-linked immunofiltration (ELIFA) or dot blot systems for parallel, vertical flow analysis (Clark et al., 1993, *Biotechnology Techniques* 7(6), 461-466; Ijsselmuiden et al., 1987, *European Journal of Clinical Microbiology* 6(3), 281-285). Therein, a membrane made from, for example, nylon, nitrocellulose, or cellulose acetate, is clamped between two plastic well plates and samples are isolated through the use of rubber gaskets.

Due to the high surface to volume ratio of the porous membrane, binding kinetics closely resemble that of proteins in solution (Shen et al., 2011, *Polymer Journal* 43(1), 35-40; Valkirs & Barton, 1985, *Clin Chem* 31(9), 1427-1431; Xu & Bao, 2003, *Anal Chem* 75(20), 5345-5351).

This reduces assay time from hours for a solid-phase immunoassay to minutes for an immunofiltration assay, and is particularly beneficial when analysing low concentration samples (Clark et al., 1993, *Biotechnology Techniques* 7(6), 461-466; Xu & Bao, ibid.). In 1991, Poulsen and Bjerrum demonstrated that in addition to speed, vertical flow can also increase the sensitivity of an immunoassay by concentrating dilute analytes in the membrane (Poulsen, F., Bjerrum, O. J., 1991, CRC Press). The high capture probe density and nm pores make it possible to bind all the analyte flowing through the matrix, creating a system sensitive to total antigen amount instead of concentration. This discovery was not well explored, likely because the minimum sample volumes were already 100s of microlitres and mm-diameter spots would have poor signal-to-noise for dilute samples.

For multiplexed analyte detection within the wells the membranes can be pre-spotted with capture probes (Chinnasamy et al., 2014, *Clin Chem* 60(9), 1209-1216; Ramachandran et al., 2013, *Diagnostics* 3(2), 244-260; Xu & Bao, 2003, *Anal Chem* 75(20), 5345-5351). The captured analytes are confined to a smaller test site for higher signal-to-noise (micron spots compared to millimetre wells), however, introducing several test sites within a sample well means analytes can pass through the membrane undetected in the areas surrounding the microspots.

An alternative method for creating vertical flow-through arrays is to pattern channels directly into the membranes (Carrilho et al., 2009, *Anal Chem* 81(16), 7091-7095; Lu et al., 2009, *Electrophoresis* 30(9), 1497-1500).

The membranes can then be irreversibly stacked (Martinez et al., 2008, *Proc Natl Acad Sci USA* 105(50), 19606-19611), or folded in the style of origami (Ge et al., 2012, *Lab Chip* 12(17), 3150-3158; Liu & Crooks, 2011, *J Am Chem Soc* 133(44), 17564-17566) to form three dimensional paper based analytical devices. With this design the patterned layers serve to distribute the sample from the inlet channel to multiple detection zones. While this approach is less expensive than robotic spotting and relies only on capillary forces, it also does not take advantage of analyte concentration during vertical flow.

A vertical flow microarray, which combines micron test sites with high capture probe density for rapid and sensitive analysis of several samples in parallel, was previously introduced (WO2011015359 A1; de Lange & Vörös, 2014, *Anal Chem* 86(9), 4209-4216). This 3D microarray performs multiplexed analyte detection on each sample and requires only μl volumes. It is referred to as the FoRe array herein.

By means of the FoRe microarray technology, immunofiltration is brought from the milli-scale to the micro-scale, and microarray multiplexing is combined with rapid low concentration sensing. The 3D FoRe array is formed by stacking wax-patterned nitrocellulose membranes, each functionalised with a different capture probe. The wax forms hydrophobic barriers around the array of antibody-loaded spots. This allows to restrict the channel diameter, reducing the minimum required volume (from 100s of μl for an ELIFA to <1 μl), and to confine the capture probes to a smaller area for increased signal-to-noise. When stacked and aligned, the nitrocellulose layers form an array of separable multiplexed affinity columns (FIG. 1), providing an inexpensive and customisable way to analyse several samples in parallel for multiple proteins.

SUMMARY OF THE INVENTION AND PARTICULAR EMBODIMENTS

The problem to be solved by the present invention is to provide a cost-efficient, small sized device for the analysis of multiple liquid samples, particularly viscous samples.

This problem is solved by the subject matter of the device according to the independent claim 1, the methods according to the claims 13 and 16, and the kit according to claim 17.

Embodiments of the device are claimed by the dependent claims 2 to 12, and embodiments of the method according to claim 13 are claimed by the dependent claims 14 and 15.

The invention relates to a radically improved version of the FoRe device comprising an inlet part to increase the sample volume flowing through the miniaturised test sites without compromising the small spot size or dense microarray layout.

With this new design, the unique ability is provided to tune the sensitivity of a microarray, depending on the available sample volume, and to perform pre-processing or extraction steps without compromising the amount of captured analyte. This is especially attractive for highly viscous or complex samples, e.g. whole blood, which can be diluted without loss of sensitivity. Also introduced is a simple technique to analyse a finger prick of blood, by diluting the sample with buffer before briefly spinning down the blood cells. The entire supernatant then flows through the microchannels to re-concentrate the analytes on the array spots.

The FoRe microarray eliminates several drawbacks of traditional solid phase arrays (i.e. large sample volumes, protein loss during pre-fractionation, and cross-reactivity between detection antibodies). The new design presented here maintains all of the original advantages and additionally makes it possible to improve the sensitivity when larger sample volumes are available or to quickly re-concentrate the analyte on test sites after dilution or extraction.

Rapid, multiplexed and sensitive analysis of low concentration analytes has a range of applications from analysing μl pricks of blood, as shown in the present specification, to environmental monitoring, where vertical flow can be used as a replacement for solid phase extraction (Morais et al., 1999, *Anal Chem* 71(9), 1905-1909).

Key features of the device are that it is inexpensive and easily customisable. The current inlet holds only 10 μl of sample, but with the angled PDMS channels sealing the top wells it is simple to change the diameter and height of the PMMA to increase the reservoir volume. Immobilization of capture probes is not restricted to a specific chemistry and can therefore be easily adapted to perform a wide range of tests using commercially available antibody pairs. Alternative patterning techniques (e.g. photolithography (Martinez et al., 2007, *Angewandte Chemie* 46(8), 1318-1320; Martinez et al., 2010, *Anal Chem* 82(1), 3-10) expand the range of compatible samples and the simplicity of patterning makes it possible to quickly scale the size of the array from one spot for point-of-care to multiple spots for high-throughput applications. This inexpensive and simple combination of vertical flow and micron test sites is likely an important step to expanding the potential of both immunofiltration and protein microarrays.

The invention has significant advantages when applied in small animal studies (e.g. mice), particularly wherever multiple measurements need to be taken over a period of time to show the development of a parameter of interest (e.g. biomarker development in drug response studies). Since the technology described here requires significantly smaller sample volumes than currently used methods, the animals can be kept alive as only non-lethal amounts of blood need to be drawn. At the same time the device described herein allows the parallel analysis of samples from multiple animals as well as the integration of standards and controls.

A second user group are antibody manufacturers and assay kit developers looking for technologies to validate or optimize their products in an economic and time saving manner. The micron-sized test sites of the device described here require only ng-amounts of antibodies to be functionalised while assay time is significantly reduced compared to other approaches.

Another application field is neonatology, where sample volumes are a limiting factor. Tests to quantify inflammation markers are routinely performed on a daily basis in hospitals. These tests require fairly large sample volumes in the range of several 100 μl. A bedside test, which is able to overcome these limits, is highly desired.

According to a first aspect of the invention, a device for analysing liquid samples is provided. The device comprises a sample layer comprising a plurality of liquid permeable test sites separated by a liquid impermeable barrier region. The device comprises an inlet part that comprises a plurality of inlet channels. Each of the inlet channels leads to and is aligned with a respective test site of a sample layer of the device, such that a flow connection between the inlet channel and the respective test site is established or can be established. The sample layer may be characterized by the parameter of its width (w). In certain embodiments, the sample layer is substantially rectangular, square-shaped, or forms a circle.

In certain embodiments, the inlet channels comprise first openings, which are positioned in a first plane, particularly parallel to the at least one sample layer, wherein the first openings are accessible from the outside of the inlet part, such that liquid samples are loadable into the inlet channels by means of the first openings, and wherein the inlet channels comprise second openings, which are positioned in a second plane, particularly parallel to the at least one sample layer, adjacent to the test sites, such that liquid samples can flow from the inlet channels to respective test sites via the second openings, wherein a first surface area is defined by the positions of the first openings in the first plane, and a second surface area is defined by the positions of the second openings in the second plane, wherein the second surface area is smaller than the first surface area. That is, the boundary of the first surface area is defined by an envelope line enclosing the outermost first openings (those openings having a maximal or minimal x-coordinate or y-coordinate of the first plane), and the boundary of the second surface area is defined by an envelope line enclosing the outermost second openings (those openings having a maximal or minimal x-coordinate or y-coordinate of the second plane).

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels comprises an angled section, wherein the angled section is arranged at an angle (alpha) of 5° to 89° with respect to a plane defined by the at least one sample layer. In certain embodiments, the angled section is positioned at an angle of 20° to 89°, particularly 45° to 89°, with respect to a plane defined by the at least one sample layer.

Advantageously, inlet channels having an angled section allow combining a large loadable sample volume with a dense spacing of test sites on the sample layer. Furthermore, the inlet channels can be positioned such that samples can be conveniently loaded into the inlet channels without compromising the dense layout of the test sites on the sample layer.

In certain embodiments, the device of the invention comprises one sample layer. In certain embodiments, the device comprises a plurality of sample layers. In certain embodiments the device comprises 2, 3, 4 or 5 sample layers.

The inlet part characterizing the device of the present invention allows significantly improving, by several orders of magnitude in terms the sample size, compared to the devices known in the art. Filtering samples through individual test sites allows rapidly analysing dilute samples with high throughput and high signal-to-noise ratio. Unlike other flow-through microarrays, the device of the present invention allows samples to be injected into sample channels and sequentially exposed to different receptors. This arrangement makes it possible to increase the sensitivity of the microarray by simply increasing the sample volume or to rapidly re-concentrate samples after pre-processing steps dilute the analyte. The inlet system disclosed herein allows increasing the analysed sample volume without compromising the dense layout of test sites. It could be demonstrated that the device is sensitive to the amount of antigen and, as a result, sample volume directly correlates to sensitivity.

Furthermore, a method for analysing viscous samples, particularly blood samples, by means of the device for analysing liquid samples comprising an inlet part is provided, wherein clogging of test sites is prevented. The method is highly sensitive and requires only small amounts of sample.

Moreover, a method for functionalising a layer, particularly to be used in the device for analysing liquid samples according to the invention, and a kit for performing the method for functionalising a layer are provided.

In certain embodiments, the device for analysing liquid samples comprises at least a top sample layer and a second sample layer, wherein the top sample layer and the second sample layer are positioned such that each test site of the top sample layer overlaps with a respective test site of the second sample layer, particularly is aligned with the respective test site, such that a liquid permeable sample channel extending through the top sample layer and the second sample layer is formed by the test sites of the top sample layer and the second sample layer.

In particular, the device for analysing liquid samples is arranged such that a flow connection between each inlet channel and a respective sample channel is established or can be established.

In certain embodiments, the device for analysing liquid samples comprises at least one additional sample layer, wherein the second sample layer is positioned between the top sample layer and the additional sample layer, and wherein each test site of the additional sample layer is aligned with a respective test site of the top sample layer and a respective test site of the second sample layer, such that a liquid permeable sample channel extending through the top sample layer, the second sample layer, and the additional sample layer is formed.

Advantageously, multiple sample layers allow coupling of different reagents, particularly antibodies to each layer, allowing the analysis of multiple components, particularly antigens, in a sample.

In certain embodiments, the device for analysing liquid samples, particularly the inlet part, comprises polydimethylsiloxane (PDMS).

Advantageously, the rubber-like characteristic of PDMS allows good sealing of a part of the device for analysing liquid samples from adjacent parts of the device for analysing liquid samples.

In certain embodiments, the inlet part comprises a non-elastic polymer, particularly polymethyl methacrylate (PMMA). In certain embodiments, the inlet part comprises a non-elastic polymer, particularly polyether ether ketone (PEEK).

In certain embodiments, the sample layers are positioned between a first sealing part and a second sealing part, wherein the first sealing part and the second sealing part particularly comprise PDMS, and wherein the first sealing part and the second sealing part prevent leakage from the sample layers.

In certain embodiments, a part of the device for analysing liquid samples, particularly the inlet part, is manufactured by injection moulding, three-dimensional micro-fabrication, three-dimensional laser cutting, or three-dimensional printing. In certain embodiments, a part of the device for analysing liquid samples, particularly the inlet part, is manufactured by computer numerical control (CNC) milling.

In certain embodiments, the barrier region comprises a hydrophobic material, particularly a wax, or a physical barrier.

Advantageously, by patterning hydrophobic wax barriers directly on the membrane samples can be isolated without the need for gaskets.

In certain embodiments, the sample layer comprises or consists of a porous material, particularly a hydro gel or paper, particularly comprising cellulose, nitrocellulose, or borosilicate, most particularly nitrocellulose.

Advantageously, nitrocellulose has a high protein binding capacity and is compatible with inexpensive wax-printing.

In certain embodiments, the porous material comprises glass capillary arrays, wherein channels are formed by patterned polymer slices, particularly comprising PDMS, above and below each glass microarray.

In certain embodiments, the device for analysing liquid samples comprises at least one layer comprising a non-porous material and having a plurality of holes, wherein each hole overlaps, particularly is aligned, with a respective inlet channel and/or at least one respective test site.

In certain embodiments, the non-porous material is PMMA or PDMS.

In certain embodiments, the at least one test site of at least one sample layer is individually functionalized by one or more molecules, which are able to interact specifically or non-specifically with one or more ligands from the liquid sample.

In the context of the present specification, the term functionalize describes exposing a sample layer to at least one reagent, particularly a protein, more particularly an antibody, wherein the reagent is allowed to form covalent or non-covalent bonds to a material comprised in the sample layer, thereby binding to the sample layer. Therefore, a functionalised sample layer comprises the at least one reagent.

In certain embodiments, the device for analysing liquid samples comprises at least one capture probe to a specific ligand, wherein the capture probe is directly attached to the test site and/or sample channel, particularly by passive adsorption or covalent coupling.

In certain embodiments, the capture probe is attached to a carrier, particularly a particle with a maximal diameter of 10 μm to 500 μm, which is embedded in the test site and/or sample channel.

In the context of the present specification, the term ligand is used in its meaning known in the art of biochemistry. It describes a substance, which binds or is able to bind to a protein.

In the context of the present specification, the term capture probe describes a substance, which binds or is able to bind to a ligand.

In the context of the present specification, the term carrier designates a substance, which binds or is able to bind to a capture probe.

In certain embodiments, the capture probe comprises an antibody.

In certain embodiments, the liquid sample comprises a cell lysate, a biopsy sample, a derivative of blood, blood itself, saliva, or urine.

In certain embodiments, the device for analysing liquid samples is adapted such that liquid samples may be guided through the test sites and/or sample channels by an external force, particularly wherein the external force is created by centrifugation, applying a pressure gradient, electrical field, magnetic field, gravitational forces, or capillary action.

In certain embodiments, the inlet channel comprises a reservoir section, which is accessible from the exterior, and a respective connecting section, wherein a flow connection between the reservoir section and the respective connecting section is established or can be established, and wherein each connecting section leads to and is aligned with a respective test site, such that a flow connection from the connecting section to the respective test site is established or can be established. The reservoir section is accessible from the outside of the inlet device, such that a liquid sample is loadable into the reservoir section. The reservoir section serves to increase the volume of liquid sample which can be loaded into the inlet channels. The connecting section connects the reservoir section and the respective test site, wherein the connecting section is positioned adjacent to the respective test site, such that the liquid sample can flow from the respective connecting section to the respective test site. In certain embodiments, the reservoir sections are comprised in a reservoir part of the inlet part, and the connecting sections are comprised in a connecting part of the inlet part, wherein the reservoir part and the connecting part are separable and exchangeable. Alternatively, in certain embodiments, the reservoir sections and the connecting sections are comprised in a single inlet part.

In certain embodiments, at least one inlet channel is positioned at an angle of 5° to 50°, particularly 10° to 45° with respect to the plane defined by the sample layer. The angle is depicted in the figures in relation to the element designated the width of the inlet part.

In certain embodiments, the reservoir section has a volume in the range of 20 μl to 1000 μl, particularly in the range of 20 μl to 300 μl.

In certain embodiments, the reservoir section has a volume of 3 μl to 50 μl, particularly 3 μl to 25 μl, more particularly 3 μl to 12 μl.

In certain embodiments, the reservoir section has a volume of 300 μl or less, particularly 45 μl or less.

In certain embodiments, the reservoir section comprises a first diameter, and the connecting section comprises a second diameter, wherein the ratio between the first diameter and the second diameter is at least 2 to 1, particularly at least 4 to 1.

In certain embodiments, the device for analysing liquid samples comprises a sealing part, which is positioned between the reservoir part and the connecting part.

In certain embodiments, the connecting sections are curved, particularly S-shaped.

In certain embodiments, each inlet channel comprises an opening, which is accessible from the outside, wherein the distance between the openings is larger than the distance between the respective test sites and/or sample channels, to which the openings are connected by means of the respective inlet channels.

Advantageously a larger distance between the openings allows to conveniently load samples into the device for analysing liquid samples, particularly by means of pipette.

In certain embodiments, the openings have a maximal diameter of 0.2 mm to 25 mm, particularly 0.3 mm to 15 mm, more particularly 0.4 mm to 5 mm, even more particularly 0.5 mm to 3 mm.

In certain embodiments, the inlet channels, particularly each of the inlet channels, comprise first openings and second openings, wherein the first openings are accessible from the outside of the inlet device, such that a liquid sample is loadable into the respective inlet channels by means of the first openings, and wherein the second openings are positioned adjacent to respective test sites, such that the liquid sample can flow from the respective inlet channels to the respective test sites via the second openings, wherein neighbouring first openings are arranged at a first centre-to-centre distance with respect to each other in a first plane, particularly which is parallel to the sample layer, and wherein neighbouring second openings are arranged at a second centre-to-centre distance with respect to each other in a second plane, particularly which is parallel to the sample layer, and wherein the ratio between the minimal first centre-to-centre distance and the minimal second centre-to-centre distance is at least 3 to 2, particularly at least 2 to 1.

The term 'centre-to-centre distance' refers to the distance of the centre points of neighboring first or second openings in the respective plane. In particular, the minimal centre-to-centre distance refers to a case, in which neighboring first or second openings have different centre-to-centre distances in the inlet part. In this case, the minimal centre-to-centre distance is defined as the smallest centre-to-centre distance of all neighboring pairs of first or second openings. If the centre-to-centre distances are equal for all pairs of neighboring first or second openings, the term 'minimal (first or second) centre-to-centre distance' can be replaced by the term '(first or second) centre-to-centre distance'.

In certain embodiments, all neighboring first openings are positioned at a first centre-to-centre distance with respect to each other. In certain embodiments, all neighboring second openings are positioned at a second centre-to-centre distance with respect to each other. That is, all neighboring first openings and/or neighboring second openings are positioned at equal centre-to-centre distances from each other.

In certain embodiments, the first opening has a maximal extension, particularly a diameter, of 1 mm to 4 mm, particularly 1.5 mm to 2.5 mm, more particularly 2 mm.

In certain embodiments, the second opening has a maximal extension, particularly a diameter, of 0.1 mm to 1 mm, particularly 0.25 mm to 0.75 mm, more particularly 0.5 mm.

In certain embodiments, the first centre-to-centre distance is 1.5 mm to 5 mm, particularly 2 mm to 3 mm, more particularly 2.7 mm.

In certain embodiments, the second centre-to-centre distance is 0.75 mm to 2 mm, particularly 1 mm to 1.5 mm, more particularly 1.2 mm.

In certain embodiments, the test sites have a maximal diameter of 10 μm to 5000 μm, particularly 100 μm to 1000 μm, most particularly 500 μm.

In certain embodiments, the diameter of the inlet channels is large enough to enable manual sample injection with a pipette or automated sample injection with a robotic spotter.

In certain embodiments, the inlet channel has a diameter, particularly a maximal diameter, of 0.2 mm to 25 mm, particularly 0.3 mm to 15 mm, more particularly 0.4 mm to 5 mm, even more particularly 0.5 mm to 3 mm.

In certain embodiments, at least one of the inlet channels has a conical shape. Therein, the inlet channel particularly comprises a first diameter, particularly a first maximal diameter, at a first end of the inlet channel, and a second diameter, particularly a second maximal diameter at a second end of the inlet channel, wherein the first diameter is greater than the second diameter.

In certain embodiments, the second end of the inlet channel is positioned adjacent to a respective test site and/or sample channel.

In certain embodiments, the first diameter ranges from 0.2 mm to 25 mm, particularly 0.3 mm to 15 mm, more particularly 0.4 mm to 5 mm, even more particularly 0.5 mm to 3 mm.

In certain embodiments, the second diameter ranges from 10 μm to 5000 μm, particularly 100 μm to 1000 μm, most particularly 500 μm.

In certain embodiments, the device for analysing liquid samples comprises a separation membrane, particularly a plasma separation membrane, wherein the separation membrane is positioned in at least one of the inlet channels.

In the context of the present specification, the term plasma separation membrane describes a membrane, which is adapted to separate components of blood plasma.

Advantageously, the separation membrane prevents clogging of the sample channels by viscous samples, particularly blood samples. Separation membranes are known to the skilled artisan. They allow for the rapid separation of blood cells from plasma, often employing coated porous polymeric materials of defined pore size and thickness. Non-limiting examples are membranes provided by International Point of Care Inc. (Toronto, Candada) and Pall Corp. Port Washington, N.Y., USA. Separation membranes are described, inter alia, in patent documents U.S. Pat. No. 6,045,899; U.S. Pat. No. 5,906,742; U.S. Pat. No. 6,565,782; U.S. Pat. No. 7,125,493; U.S. Pat. No. 6,939,468; U.S. Pat. No. 6,440,306; U.S. Pat. No. 6,110,369; U.S. Pat. No. 5,979,670; U.S. Pat. No. 5,846,422 or U.S. Pat. No. 6,277,281, all of which are incorporated herein by reference.

In certain embodiments, the device for analysing liquid samples comprises a plurality of pins, particularly of metal, each sample layer comprises a plurality of slots, and the inlet part comprises a plurality of slots, wherein each pin is adapted to protrude through a plurality of slots so that the sample layers and the inlet part may be positioned in a fixed arrangement with respect to each other by means of the pins.

In certain embodiments, the device for analysing liquid samples comprises a frame, wherein the frame is adapted to position the sample layers and the inlet part in a fixed arrangement with respect to each other.

In certain embodiments, the inlet part comprises a top plate and a bottom plate, wherein the bottom plate comprises a plurality of outlets, which are alignable with the plurality of test sites of a sample layer of the device.

In certain embodiments, the device comprises at least one clamp or at least one spring-loaded tension lock, wherein the clamp or the spring-loaded tension lock provides a compressing force on the top plate and the bottom plate.

Advantageously, providing a compressing force seals the device for analysing liquid samples against leakage of sample, particularly between individual inlet channels.

In certain embodiments, the device for analysing liquid samples comprises a plurality of collection receptacles, wherein each collection receptacle is positionable or positioned such that sample exiting a respective test site and/or sample channel may be collected by means of the collection receptacle.

In certain embodiments, the inlet part comprises a hydrophobic membrane positioned between the inlet part and the at least one sample layer, wherein the hydrophobic membrane comprises a plurality of holes, and wherein each of the holes overlaps, particularly is aligned, with a respective inlet channel of the inlet part.

In certain embodiments, the diameter of the hole matches the diameter of the respective inlet channel overlapping with the hole.

Advantageously, the hydrophobic membrane serves to let air trapped in the inlet channels escape, particularly in case of multiple serial sample injections, whereas samples are confined in the device.

In certain embodiments, the inlet channel comprises at least one air passage which connects the inlet channel to the exterior.

In certain embodiments, the air passage has a maximal diameter of 10 μm to 1000 μm, particularly 100 μm to 500 μm.

Advantageously, air trapped in the channels may escape through the air passages, particularly in case of multiple serial sample injections.

In certain embodiments, the maximal diameter of the air passage increases towards the exterior of the device.

Advantageously, an increasing diameter of the air passages prevents sample leakage, particularly in case of centrifugation.

In certain embodiments, the inner walls of the air passage have a hydrophobic surface.

Advantageously a hydrophobic surface of the air passages prevents sample leakage, particularly in case of capillary action.

In certain embodiments, the device for analysing liquid samples comprises an optical unit, wherein the optical unit is adapted to provide light, particularly excitation light to a fluorophore and/or measure light, particularly fluorescence emitted by a fluorophore.

In certain embodiments, the optical unit comprises a light source, wherein the light source is adapted to provide light, particularly excitation light to a fluorophore.

In certain embodiments, the optical unit comprises a photo detector, wherein the photo detector is adapted to generate a signal in response to light, particularly fluorescence emitted from a fluorophore.

In certain embodiments, the optical unit is positioned directly adjacent to the test sites and/or sample channels.

In certain embodiments, the optical unit comprises at least one optical fibre, wherein the at least one optical fibre is adapted to guide light from at least one light source to at least one test site and/or from at least one test site to at least one photo detector.

In certain embodiments, the optical fibre has a maximal diameter of 10 μm to 5000 μm, particularly 100 μm to 1000 μm.

In certain embodiments, the optical fibre is adapted to guide light emitted from a test site to at least one photo detector via at least one optical filter.

In certain embodiments, the device for analysing liquid samples comprises an electrochemical unit, particularly comprising an electrode, more particularly a microelectrode wherein the electrochemical unit is adapted to measure an electrochemical potential in the at least one test site.

In certain embodiments, the device for analysing liquid samples comprises a plurality of microelectrodes, wherein each microelectrode is positioned at a respective test site.

In certain embodiments, the microelectrode comprises gold.

In certain embodiments, the microelectrode has a size in the range from 50 μm to 300 μm, particularly from 200 μm to 300 μm.

In certain embodiments, the electrochemical unit comprises a reference electrode, particularly an Ag/AgCl reference electrode.

Advantageously, the concentration of a substance, particularly an antigen, present at the test may be determined by providing an enzyme-linked antibody, which binds to the substance, and providing a reporter substrate, which is chemically modified by the enzyme linked to the antibody, wherein the modification reaction generates an electrochemical signal, which is measureable by means of the electrochemical unit.

According to a second aspect of the invention a method for analysing liquid samples by means of the device according to the first aspect of the invention is provided. The method comprises the steps of loading a liquid sample into a respective inlet channel of the inlet part in a loading step, passing the liquid sample through a respective test site and/or sample channel, which is connected to the respective inlet channel, in an assay step, and analysing substances bound to the test sites of a sample layer of the device in an analysis step.

In certain embodiments, an external force is applied in order to pass each liquid sample through a respective test site and/or sample channel of the device for analysing liquid samples.

In certain embodiments, the external force is created by centrifugation, applying a pressure gradient, electrical field, magnetic field, gravitational forces, or capillary action in the assay step.

In certain embodiments, at least one of the liquid samples is a viscous sample having a dynamic viscosity of at least $3\cdot10^{-3}$ Pa·s ($3\cdot10^{-3}$ kg·m$^{-1}$ s$^{-1}$), wherein the viscous sample is diluted by a dilution factor in a dilution step prior to the loading step.

In certain embodiments, the dilution factor is 1:2 to 1:20, particularly 1:2 to 1:10.

In the context of the present specification, the term viscous sample designates a sample having a dynamic viscosity of at least $3\cdot10^{-3}$ Pa·s ($3\cdot10^{-3}$ kg·m$^{-1}$ s$^{-1}$).

In certain embodiments, the viscous sample comprises a first component and a second component, wherein the first component is separated from the second component in a separation step after the dilution step and prior to the loading step.

In certain embodiments, the first component is a soluble component, and the second component is an insoluble component.

In certain embodiments, the separation step comprises centrifugation or filtration.

In certain embodiments, the viscous sample is a blood sample.

In certain embodiments, the viscous sample is a blood sample from a finger prick, or an infant heel prick, or a blood sample from a small animal, particularly a blood sample from a tail vein prick of a small rodent.

In certain embodiments, the viscous sample comprises protein aggregates.

According to a third aspect of the invention, a method for functionalising a sample layer is provided. The method comprises the steps of providing a sample layer, wherein the sample layer comprises a plurality of liquid permeable test sites separated by a liquid impermeable barrier region, providing a reagent, which is able to bind to the test sites of the sample layer, providing an inlet part comprising a plurality of inlet channels, and wherein each of the inlet channels leads to and is aligned with a respective test site of the sample layer, such that a flow connection between the inlet channel and the respective test site is established or can be established, assembling the inlet part and the sample layer, such that each test site of the sample layer is aligned with a respective inlet channel of the inlet part, such that a flow connection from the inlet channel to the respective test site is established or can be established, loading the reagent into a respective inlet channel, and passing the reagent through the respective test site, such that the reagent may bind to material comprised in the respective test site.

In certain embodiments, the inlet channels comprise first openings, which are positioned in a first plane, particularly parallel to the at least one sample layer, wherein the first openings are accessible from the outside of the inlet part, such that liquid samples are loadable into the inlet channels by means of the first openings, and wherein the inlet channels comprise second openings, which are positioned in a second plane, particularly parallel to the at least one sample layer, adjacent to the test sites, such that liquid samples can flow from the inlet channels to respective test sites via the second openings, wherein a first surface area is defined by the positions of the first openings in the first plane, and a second surface area is defined by the positions of the second openings in the second plane, wherein the second surface area is smaller than the first surface area.

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels comprises an angled section, wherein the angled section is arranged at an angle of 5° to 89° with respect to a plane defined by the sample layer.

Advantageously, functionalising a sample layer by means of an inlet part allows to expose individual test sites of a single layer to different reagents.

Furthermore, functionalising a sample layer by means of the inlet part results in higher reproducibility than spotting the reagent manually on the test sites.

In certain embodiments, an external force is applied to pass the at least one reagent through the respective test site.

In certain embodiments, the external force is created by centrifugation, applying a pressure gradient, electrical field, magnetic field, gravitational forces, or capillary action.

According to a fourth aspect of the invention, a kit for performing the steps of the method according to the third aspect is provided, wherein the kit comprises a sample layer, wherein the sample layer comprises a plurality of liquid permeable test sites separated by a liquid impermeable barrier region, a reagent, which is able to bind to the test sites, and an inlet part, wherein the inlet part comprises a plurality of inlet channels, and wherein each of the inlet channels leads to and is aligned with a respective test site of the sample layer, such that a flow connection between the inlet channel and the respective test site is established or can be established.

In certain embodiments, the inlet channels comprise first openings, which are positioned in a first plane, particularly parallel to the at least one sample layer, wherein the first openings are accessible from the outside of the inlet part, such that liquid samples are loadable into the inlet channels by means of the first openings, and wherein the inlet channels comprise second openings, which are positioned in a second plane, particularly parallel to the at least one sample layer adjacent to the test sites, such that liquid samples can flow from the inlet channels to respective test sites via the second openings, wherein a first surface area is defined by the positions of the first openings in the first plane, and a second surface area is defined by the positions of the second openings in the second plane, wherein the second surface area is smaller than the first surface area.

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels of the inlet part comprises an angled section, wherein the angled section is arranged at an angle of 5° to 89° with respect to the width of the inlet part.

According to a fifth aspect of the invention, a device for analysing liquid samples is provided, wherein the device comprises at least one sample layer comprising a plurality of liquid permeable test sites separated from each other by a liquid impermeable barrier region, wherein the device comprises an inlet part, wherein the inlet part comprises a plurality of inlet channels, and wherein the inlet channels lead to respective test sites of the at least one sample layer of the device, such that a flow connection between the inlet channels and the respective test sites is established or can be established, wherein the inlet channels comprise first openings, which are positioned in a first plane, particularly parallel to the at least one sample layer, wherein the first openings are accessible from the outside of the inlet part, such that liquid samples are loadable into the inlet channels by means of the first openings, and wherein the inlet channels comprise second openings, which are positioned in a second plane, particularly parallel to the at least one sample layer, adjacent to the test sites, such that liquid samples can flow from the inlet channels to respective test sites via the second openings, wherein a first surface area is defined by the positions of the first openings in the first plane, and a second surface area is defined by the positions of the second openings in the second plane, wherein the second surface area is smaller than the first surface area.

That is, the boundary of the first surface area is defined by an envelope line enclosing the outermost first openings (those openings having a maximal or minimal x-coordinate or y-coordinate of the first plane), and the boundary of the second surface area is defined by an envelope line enclosing the outermost second openings (those openings having a maximal or minimal x-coordinate or y-coordinate of the second plane).

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels comprises an angled section, wherein the angled section is arranged at an angle of 5° to 89° with respect to a plane defined by the at least one sample layer. Therein, the term 'angled section' refers to either a part of the respective inlet section or the entire inlet section.

That is, at least one inlet channel contains an angled section or the inlet channel as a whole is arranged at an angle. Therein the term 'section arranged at an angle' designates that the longitudinal axis of the respective section is arranged at the angle with respect to the plane defined by the at least one sample layer. The inlet part may additionally contain inlet channels that do not comprise an angled section, that is inlet channels which are arranged at an angle of 90° with respect to the plane of the sample layer.

In particular, an angled section may also be a curved section, wherein the angle of the curved section with respect to the plane defined by the sample layer changes along the section.

Advantageously, inlet channels having an angled section allow combining a large loadable sample volume with a dense spacing of test sites on the sample layer. Furthermore, the inlet channels can be positioned such that samples can be conveniently loaded into the inlet channels without compromising the dense layout of the test sites on the sample layer.

In certain embodiments, the width of the inlet part is arranged in parallel with the plane of the at least one sample layer. That is, the angle is defined with respect to the width of the inlet part.

In certain embodiments, the inlet part comprises angled sections arranged at different angles with respect to the at least one sample layer. In certain embodiments, the angle decreases from inlet channels positioned at the outer boundary of the inlet part to inlet channels positioned near or at the center of the inlet part.

In certain embodiments, the device of the invention comprises one sample layer. In certain embodiments, the device comprises a plurality of sample layers. In certain embodiments the device comprises 2, 3, 4 or 5 sample layers.

The inlet part characterizing the device of the present invention allows significantly improving, by several orders of magnitude of the sample size, compared to the devices known in the art. Filtering samples through individual test sites allows rapidly analysing dilute samples with high throughput and high signal-to-noise ratio. Unlike other flow-through microarrays, the device of the present invention allows samples to be injected into sample channels and sequentially exposed to different receptors. This arrangement makes it possible to increase the sensitivity of the microarray by simply increasing the sample volume or to rapidly re-concentrate samples after pre-processing steps dilute the analyte. The inlet system having at least one angled channel disclosed herein allows increasing the analysed sample volume without compromising the dense layout of test sites. It could be demonstrated that the device is sensitive to the amount of antigen and, as a result, sample volume directly correlates to sensitivity.

All assays of the prior art are limited by the concentration of the analyte while the present invention allows performing assays which are limited by the total amount of sample. This is especially beneficial because the method facilitates the analysis of diluted samples. Whereas the recent tendency in the field of microarrays is the reduction of sample values, the dilution of samples results in an increase of sample volume. The device comprising angled channels according to the present invention is especially advantageous for applying large sample volumes, i.e. of diluted samples to a dense array of test sites. The flow through setup of the device for analyzing liquid samples described herein is especially well-suited for the analysis of large volume samples.

In certain embodiments, the device for analysing liquid samples comprises at least a top sample layer and a second sample layer, wherein the top sample layer and the second sample layer are positioned such that the test sites of the top sample layer overlap with respective test sites of the second sample layer, particularly are aligned with the respective test sites, such that a liquid permeable sample channel extending through the top sample layer and the second sample layer is formed by the test sites of the top sample layer and the second sample layer.

In particular, the device for analysing liquid samples is arranged such that a flow connection between the inlet channels and the respective sample channels is established or can be established.

In certain embodiments, the device for analysing liquid samples comprises at least one additional sample layer, wherein the second sample layer is positioned between the top sample layer and the additional sample layer, and wherein the test sites of the additional sample layer are aligned with respective test sites of the top sample layer and respective test sites of the second sample layer, such that a liquid permeable sample channel extending through the top sample layer, the second sample layer, and the additional sample layer is formed.

Advantageously, multiple sample layers allow coupling of different reagents, particularly antibodies, to each layer, allowing the analysis of multiple components, particularly antigens, in a sample.

In certain embodiments, the device for analysing liquid samples, particularly the inlet part, comprises polydimethylsiloxane (PDMS).

Advantageously, the rubber-like characteristic of PDMS allows good sealing of a part of the device for analysing liquid samples from adjacent parts of the device for analysing liquid samples.

In certain embodiments, the inlet part comprises a non-elastic polymer, particularly polymethyl methacrylate (PMMA). In certain embodiments, the inlet part comprises a non-elastic polymer, particularly polyether ether ketone (PEEK).

In certain embodiments, the sample layers are positioned between a first sealing part and a second sealing part, wherein the first sealing part and the second sealing part particularly comprise PDMS, and wherein the first sealing part and the second sealing part prevent leakage from the sample layers.

In certain embodiments, a part of the device for analysing liquid samples, particularly the inlet part, is manufactured by injection moulding, three-dimensional micro-fabrication, three-dimensional laser cutting, or three-dimensional printing. In certain embodiments, a part of the device for analysing liquid samples, particularly the inlet part, is manufactured by computer numerical control (CNC) milling.

In certain embodiments, the barrier region comprises a hydrophobic material, particularly a wax, or a physical barrier.

Advantageously, by patterning hydrophobic wax barriers directly on the membrane samples can be isolated without the need for gaskets.

In certain embodiments, the sample layer comprises or consists of a porous material, particularly a hydro gel or paper, particularly comprising cellulose, nitrocellulose, or borosilicate, most particularly nitrocellulose.

Advantageously, nitrocellulose has a high protein binding capacity and is compatible with inexpensive wax-printing.

In certain embodiments, the porous material comprises glass capillary arrays, wherein channels are formed by patterned polymer slices, particularly comprising PDMS, above and below each glass microarray.

In certain embodiments, the device for analysing liquid samples comprises at least one layer comprising a non-porous material and having a plurality of holes, wherein the holes overlap, particularly are aligned, with a respective inlet channel and/or at least one respective test site.

In certain embodiments, the non-porous material is PMMA or PDMS.

In certain embodiments, the at least one test site of at least one sample layer is individually functionalized by one or more molecules, which are able to interact specifically or non-specifically with one or more ligands from the liquid sample.

In the context of the present specification, the term functionalize describes exposing a sample layer to at least one reagent, particularly a protein, more particularly an antibody, wherein the reagent is allowed to form covalent or non-covalent bonds to a material comprised in the sample layer, thereby binding to the sample layer. Therefore, a functionalised sample layer comprises the at least one reagent.

In certain embodiments, the device for analysing liquid samples comprises at least one capture probe to a specific ligand, wherein the capture probe is directly attached to the test site and/or sample channel, particularly by passive adsorption or covalent coupling.

In certain embodiments, the capture probe is attached to a carrier, particularly a particle with a maximal diameter of 10 μm to 500 μm, which is embedded in the test site and/or sample channel.

In the context of the present specification, the term ligand is used in its meaning known in the art of biochemistry. It describes a substance, which binds or is able to bind to a protein.

In the context of the present specification, the term capture probe describes a substance, which binds or is able to bind to a ligand.

In the context of the present specification, the term carrier designates a substance, which binds or is able to bind to a capture probe.

In certain embodiments, the capture probe comprises an antibody.

In certain embodiments, the liquid sample comprises a cell lysate, a biopsy sample, a derivative of blood, blood itself, saliva, or urine.

In certain embodiments, the device for analysing liquid samples is adapted such that liquid samples may be guided through the test sites and/or sample channels by an external force, particularly wherein the external force is created by centrifugation, applying a pressure gradient, electrical field, magnetic field, gravitational forces, or capillary action.

In certain embodiments, the angled section is positioned at an angle of 5° to 50°, particularly at an angle of 10° to 45°, with respect to the plane defined by the at least one sample layer. In certain embodiments, at least one inlet channel is positioned at an angle of 5° to 50°, particularly 10° to 45° with respect to the plane defined by the at least one sample layer. The angle is depicted in the figures in relation to the element designated the width of the inlet part.

In certain embodiments, the angled section is positioned at an angle of 20° to 89°, particularly 45° to 89° with respect to the plane defined by the at least one sample layer.

In certain embodiments, the inlet channels comprise a reservoir section and a connecting section, wherein the connecting section leads to a respective test site.

In certain embodiments, the inlet channel comprises a reservoir section, which is accessible from the exterior, and a respective connecting section, wherein a flow connection between the reservoir section and the respective connecting section is established or can be established, and wherein the connecting section leads to and is aligned with a respective test site, such that a flow connection from the connecting section to the respective test site is established or can be established. The reservoir section is accessible from the outside of the inlet device, such that a liquid sample is loadable into the reservoir section. The reservoir section serves to increase the volume of liquid sample which can be loaded into the inlet channels. The connecting section connects the reservoir section and the respective test site, wherein the connecting section is positioned adjacent to the respective test site, such that the liquid sample can flow from the respective connecting section to the respective test site. In certain embodiments, the reservoir sections are comprised in a reservoir part of the inlet part, and the connecting sections are comprised in a connecting part of the inlet part, wherein the reservoir part and the connecting part are separable and exchangeable. Alternatively, in certain embodiments, the reservoir sections and the connecting sections are comprised in a single inlet part.

In certain embodiments, the device for analysing liquid samples comprises a sealing part, which is positioned between the reservoir part and the connecting part.

In certain embodiments, the connecting sections are curved, particularly S-shaped.

In certain embodiments, the reservoir section comprises a first diameter, and the connecting section comprises a second diameter, wherein the ratio between the first diameter and the second diameter is at least 2 to 1, particularly at least 4 to 1.

Therein, the term 'diameter' is not restricted to inlet channels or sections thereof having a circular cross-section. In particular, for inlet channels having a non-circular (i.e. polygonal or oval-shaped) cross-section, the term 'diameter' refers to a maximal extension of the inlet channel or section along the direction of the cross-section. Advantageously, a reduced diameter of the connecting section compared to the reservoir section allows a dense layout of test sites on the sample layer combined with a large volume of the reservoir sections. This is especially advantageous in combination with angled channels.

In certain embodiments, neighbouring first openings are arranged at a first centre-to-centre distance with respect to each other in the first plane, wherein neighbouring second openings are arranged at a second centre-to-centre distance with respect to each other in the second plane, and wherein the ratio between the minimal first centre-to-centre distance and the minimal second centre-to-centre distance is at least 3 to 2, particularly at least 2 to 1.

The term 'centre-to-centre distance' refers to the distance of the centre points of neighboring first or second openings in the respective plane. In particular, the minimal centre-to-centre distance refers to a case, in which neighboring first or second openings have different centre-to-centre distances in the inlet part. In this case, the minimal centre-to-centre distance is defined as the smallest centre-to-centre distance of all neighboring pairs of first or second openings. If the centre-to-centre distances are equal for all pairs of neighboring first or second openings, the term 'minimal (first or second) centre-to-centre distance' can be replaced by the term '(first or second) centre-to-centre distance'.

In certain embodiments, all neighboring first openings are positioned at a first centre-to-centre distance with respect to each other. In certain embodiments, all neighboring second openings are positioned at a second centre-to-centre distance with respect to each other. That is, all neighboring first openings and/or neighboring second openings are positioned at equal distances from each other.

In certain embodiments, the first openings have a maximal extension, particularly a diameter, of 1 mm to 4 mm, particularly 1.5 mm to 2.5 mm, more particularly 2 mm.

In certain embodiments, the second openings have a maximal extension, particularly a diameter, of 0.1 mm to 1 mm, particularly 0.25 mm to 0.75 mm, more particularly 0.5 mm.

In certain embodiments, the first centre-to-centre distance is 1.5 mm to 5 mm, particularly 2 mm to 3 mm, more particularly 2.7 mm.

In certain embodiments, the second centre-to-centre distance is 0.75 mm to 2 mm, particularly 1 mm to 1.5 mm, more particularly 1.2 mm.

Advantageously, this allows a dense layout of test sites on the sample layer combined with a large volume of the reservoir sections.

In certain embodiments, the inlet channels comprise openings, particularly first openings, which are accessible from the outside, wherein the centre-to-centre distance between the openings, particularly the first openings, is larger than the centre-to-centre distance between the respective test sites and/or sample channels, to which the openings are connected by means of the respective inlet channels.

Advantageously a larger centre-to-centre distance between the openings allows to conveniently load samples into the device for analysing liquid samples, particularly by means of pipette.

In certain embodiments, the openings, particularly the first openings, have a maximal diameter of 0.2 mm to 25 mm, particularly 0.3 mm to 15 mm, more particularly 0.4 mm to 5 mm, even more particularly 0.5 mm to 3 mm.

In certain embodiments, the test sites have a maximal diameter of 10 μm to 5000 μm, particularly 100 μm to 1000 μm, most particularly 500 μm.

In certain embodiments, the diameter of the inlet channels is large enough to enable manual sample injection with a pipette or automated sample injection with a robotic spotter.

In certain embodiments, the inlet channel has a diameter, particularly a maximal diameter, of 0.2 mm to 25 mm, particularly 0.3 mm to 15 mm, more particularly 0.4 mm to 5 mm, even more particularly 0.5 mm to 3 mm.

In certain embodiments, the reservoir section has a volume in the range of 10 μl to 1000 μl, particularly in the range of 20 μl to 300 μl.

In certain embodiments, the reservoir section has a volume of 3 μl to 50 μl, particularly 3 μl to 25 μl, more particularly 3 μl to 12 μl.

In certain embodiments, the reservoir section has a volume of 300 μl or less, particularly 45 μl or less.

Advantageously, an enlarged reservoir section allows the loading of larger sample volumes, facilitating flow through microarrays with diluted samples.

In certain embodiments, at least one of the inlet channels has a conical shape. Therein, the inlet channel particularly comprises a first diameter, particularly a first maximal diameter, at a first end of the inlet channel, and a second diameter, particularly a second maximal diameter at a second end of the inlet channel, wherein the first diameter is greater than the second diameter.

In certain embodiments, the second end of the inlet channel is positioned adjacent to a respective test site and/or sample channel, that is in direct flow connection with the respective test site and/or sample channel.

In certain embodiments, the first diameter ranges from 0.2 mm to 25 mm, particularly 0.3 mm to 15 mm, more particularly 0.4 mm to 5 mm, even more particularly 0.5 mm to 3 mm.

In certain embodiments, the second diameter ranges from 10 μm to 5000 μm, particularly 100 μm to 1000 μm, most particularly 500 μm.

In certain embodiments, the device comprises a separation membrane, particularly a plasma separation membrane, wherein the separation membrane is positioned in at least one of the inlet channels.

In the context of the present specification, the term plasma separation membrane describes a membrane, which is adapted to separate components of blood plasma.

Advantageously, the separation membrane prevents clogging of the sample channels by viscous samples, particularly blood samples. Separation membranes are known to the skilled artisan. They allow for the rapid separation of blood cells from plasma, often employing coated porous polymeric materials of defined pore size and thickness. Non-limiting examples are membranes provided by International Point of Care Inc. (Toronto, Canada) and Pall Corp. Port Washington, N.Y., USA. Separation membranes are described, inter alia, in patent documents U.S. Pat. No. 6,045,899; U.S. Pat. No. 5,906,742; U.S. Pat. No. 6,565,782; U.S. Pat. No. 7,125,493; U.S. Pat. No. 6,939,468; U.S. Pat. No. 6,440,306; U.S. Pat. No. 6,110,369; U.S. Pat. No. 5,979,670; U.S. Pat. No. 5,846,422 or U.S. Pat. No. 6,277,281, all of which are incorporated herein by reference.

In certain embodiments, the device for analysing liquid samples comprises a plurality of pins, particularly of metal, the sample layers comprise a plurality of slots, and the inlet part comprises a plurality of slots, wherein each pin is adapted to protrude through a plurality of slots so that the sample layers and the inlet part may be positioned in a fixed arrangement with respect to each other by means of the pins.

In certain embodiments, the device for analysing liquid samples comprises a frame, wherein the frame is adapted to position the sample layers and the inlet part in a fixed arrangement with respect to each other.

In certain embodiments, the inlet part comprises a top plate and a bottom plate, wherein the bottom plate comprises a plurality of outlets, which are alignable with the plurality of test sites of a sample layer of the device.

In certain embodiments, the device comprises at least one clamp or at least one spring-loaded tension lock, wherein the clamp or the spring-loaded tension lock provides a compressing force on the top plate and the bottom plate.

Advantageously, providing a compressing force seals the device for analysing liquid samples against leakage of sample, particularly between individual inlet channels.

In certain embodiments, the device for analysing liquid samples comprises a plurality of collection receptacles, wherein the collection receptacles are positionable or positioned such that sample exiting a respective test site and/or sample channel may be collected by means of the collection receptacle.

In certain embodiments, the inlet part comprises a hydrophobic membrane positioned between the inlet part and the at least one sample layer, wherein the hydrophobic membrane comprises a plurality of holes, and wherein the holes overlap, particularly are aligned, with respective inlet channels of the inlet part.

In certain embodiments, the diameter of the holes matches the diameter of the respective inlet channels overlapping with the holes.

Advantageously, the hydrophobic membrane serves to let air trapped in the inlet channels escape, particularly in case of multiple serial sample injections, whereas samples are confined in the device.

In certain embodiments, the inlet channel comprises at least one air passage, which connects the inlet channel to the exterior.

In certain embodiments, the air passage has a maximal diameter of 10 μm to 1000 μm, particularly 100 μm to 500 μm.

Advantageously, air trapped in the channels may escape through the air passages, particularly in case of multiple serial sample injections.

In certain embodiments, the maximal diameter of the air passage increases towards the exterior of the device.

Advantageously, an increasing diameter of the air passages prevents sample leakage, particularly in case of centrifugation.

In certain embodiments, the inner walls of the air passage have a hydrophobic surface.

Advantageously a hydrophobic surface of the air passages prevents sample leakage, particularly in case of capillary action.

In certain embodiments, the device for analysing liquid samples comprises an optical unit adapted to provide excitation light to a fluorophore and/or to measure light, particularly fluorescence, emitted by a fluorophore.

In certain embodiments, the optical unit comprises a light source, wherein the light source is adapted to provide light, particularly excitation light to a fluorophore.

In certain embodiments, the optical unit comprises a photo detector, wherein the photo detector is adapted to generate a signal in response to light, particularly fluorescence emitted from a fluorophore.

In certain embodiments, the optical unit is positioned directly adjacent to the test sites and/or sample channels.

In certain embodiments, the optical unit comprises at least one optical fibre, wherein the at least one optical fibre is adapted to guide light from at least one light source to at least one test site and/or from at least one test site to at least one photo detector.

In certain embodiments, the optical fibre has a maximal diameter of 10 μm to 5000 μm, particularly 100 μm to 1000 μm.

In certain embodiments, the optical fibre is adapted to guide light emitted from a test site to at least one photo detector via at least one optical filter.

In certain embodiments, the device for analysing liquid samples comprises an electrochemical unit, particularly comprising an electrode, more particularly a microelectrode, wherein the electrochemical unit is adapted to measure an electrochemical potential in the at least one test site.

In certain embodiments, the device for analysing liquid samples comprises a plurality of microelectrodes, wherein the microelectrodes are positioned at respective test sites.

In certain embodiments, the microelectrode comprises gold.

In certain embodiments, the microelectrode has a size in the range from 50 μm to 300 μm, particularly from 200 μm to 300 μm.

In certain embodiments, the electrochemical unit comprises a reference electrode, particularly an Ag/AgCl reference electrode.

Advantageously, the concentration of a substance, particularly an antigen, present at the test site may be determined by providing an enzyme-linked antibody, which binds to the substance, and providing a reporter substrate, which is chemically modified by the enzyme linked to the antibody, wherein the modification reaction generates an electrochemical signal, which is measureable by means of the electrochemical unit.

According to a sixth aspect of the invention a method for analysing liquid samples by means of the device according to the fifth aspect of the invention is provided. The method comprises the steps of loading a liquid sample into a respective inlet channel of the inlet part in a loading step, passing the liquid sample through a respective test site and/or sample channel, which is connected to the respective inlet channel, in an assay step, and analysing substances bound to the test sites of a sample layer of the device in an analysis step.

In certain embodiments, an external force is applied in order to pass each liquid sample through a respective test site and/or sample channel of the device for analysing liquid samples.

In certain embodiments, the external force is created by centrifugation, applying a pressure gradient, electrical field, magnetic field, gravitational forces, or capillary action in the assay step.

In certain embodiments, at least one of the liquid samples is a viscous sample having a dynamic viscosity of at least $3\cdot10^{-3}$ Pa·s ($3\cdot10^{-3}$ kg·m$^{-1}$ s$^{-1}$), wherein the viscous sample is diluted by a dilution factor in a dilution step prior to the loading step.

In certain embodiments, the dilution factor is 1:2 to 1:20, particularly 1:2 to 1:10.

In the context of the present specification, the term viscous sample designates a sample having a dynamic viscosity of at least $3\cdot10^{-3}$ Pa·s ($3\cdot10^{-3}$ kg·m$^{-1}$ s$^{-1}$).

In certain embodiments, the viscous sample comprises a first component and a second component, wherein the first component is separated from the second component in a separation step after the dilution step and prior to the loading step.

In certain embodiments, the first component is a soluble component, and the second component is an insoluble component.

In certain embodiments, the separation step comprises centrifugation or filtration.

In certain embodiments, the viscous sample is a blood sample.

In certain embodiments, the viscous sample is a blood sample from a finger prick, or an infant heel prick, or a blood sample from a small animal, particularly a blood sample from a tail vein prick of a small rodent.

In certain embodiments, the viscous sample comprises protein aggregates.

According to a seventh aspect of the invention, a method for functionalising a sample layer is provided. The method comprises the steps of providing a sample layer, wherein the sample layer comprises a plurality of liquid permeable test sites separated by a liquid impermeable barrier region, providing a reagent, which is able to bind to the test sites, providing an inlet part comprising a plurality of inlet channels, wherein the inlet channels comprise first openings, which are positioned in a first plane, wherein the first openings are accessible from the outside of the inlet part, such that liquid samples are loadable into the inlet channels by means of the first openings, and wherein the inlet channels comprise second openings, which are positioned in a second plane, wherein a first surface area is defined by the positions of the first openings in the first plane, and a second surface area is defined by the positions of the second openings in the second plane, wherein the second surface area is smaller than the first surface area, assembling the inlet part and the sample layer, such that the test sites of the sample layer are aligned with respective second openings, particularly wherein the first plane and the second plane are parallel to the sample layer, such that liquid samples can flow from the inlet channels of the inlet part to respective test sites of the sample layer via the second openings, loading the reagent into at least one inlet channel, and passing the reagent through the respective test site, which is in flow connection with the at least one inlet channel.

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels comprises an angled section, wherein the angled section is arranged at an angle of 5° to 89° with respect to a plane defined by the sample layer, Advantageously, functionalising a sample layer by means of an inlet part allows to expose individual test sites of a single layer to different reagents.

Furthermore, functionalising a sample layer by means of the inlet part results in higher reproducibility than spotting the reagent manually on the test sites.

In certain embodiments, an external force is applied to pass the at least one reagent through the respective test site.

In certain embodiments, the external force is created by centrifugation, applying a pressure gradient, electrical field, magnetic field, gravitational forces, or capillary action.

According to an eighth aspect of the invention, a kit for performing the steps of the method according to the seventh aspect is provided, wherein the kit comprises a sample layer, wherein the sample layer comprises a plurality of liquid permeable test sites separated by a liquid impermeable barrier region, a reagent, which is able to bind to the test sites, and an inlet part, wherein the inlet part comprises a plurality of inlet channels, and wherein the inlet channels lead to and are aligned with respective test sites of the sample layer, such that a flow connection between the inlet channels and the respective test sites is established or can be established, and wherein the inlet channels comprise first openings, which are positioned in a first plane, particularly parallel to the at least one sample layer, wherein the first openings are accessible from the outside of the inlet part, such that liquid samples are loadable into the inlet channels by means of the first openings, and wherein the inlet channels comprise second openings, which are positioned in a second plane, particularly parallel to the at least one sample layer, such that liquid samples can flow from the inlet channels to respective test sites via the second openings, wherein a first surface area is defined by the positions of the first openings in the first plane, and a second surface area is defined by the positions of the second openings in the second plane, wherein the second surface area is smaller than the first surface area.

In certain embodiments, the ratio between the first surface area and the second surface area is at least 2 to 1, particularly at least 10 to 1.

In certain embodiments, the ratio between the first surface area and the second surface area is in the range between 2 to 1 and 10 to 1.

In certain embodiments, at least one of the inlet channels comprises an angled section, wherein the angled section is arranged at an angle of 5° to 89° with respect to a width of the inlet part.

Wherever alternatives for single separable features are laid out herein as "embodiments", it is to be understood that such alternatives may be combined freely to form discrete embodiments of the invention disclosed herein.

The invention is further illustrated by the following examples and figures, from which further embodiments and advantages can be drawn. These examples are meant to illustrate the invention but not to limit its scope.

SHORT DESCRIPTION OF THE FIGURES

FIG. 1 shows a schematic of the FoRe microarray. A) Each layer of nitrocellulose is patterned with an array of 400 μm wax channels and functionalised with a different capture antibody. The layers are aligned with help of four pins, creating an array of multiplexed affinity columns. B) The nitrocellulose stack is clamped between a solid PMMA inlet and outlet to ensure contact and prevent leaking. Samples are funnelled from a 1.3 mm inlet well through 500 μm angled channels in PDMS to the wax-patterned nitrocellulose channels.

FIG. 2A shows a schematic of the model sandwich assay detecting mouse IgG and a side view of one channel to illustrate how the functionalised nitrocellulose was stacked.

FIGS. 2B & C shows dose response curves at different antigen amounts and sample sizes. B) Six different volumes of mouse IgG (1 to 6 μl, in 1 μl increments) were injected into the FoRe device. Three different concentrations (5 pM, 25 pM, and 100 pM) were selected. The data points are the average of three spots from a single experiment (six for the negative controls for 25 pM and 100 pM) and the error bars are the standard deviation between the spots. C) For the data points depicted as squares, mouse IgG was diluted from 100 pM to 17 pM and the volume injected was adjusted to keep the antigen amount constant. The data points depicted as circles represent the same volumes, but without diluting the mouse IgG (constant 100 pM concentration). The error bars are the standard deviation between three spots in a single experiment (six for the negative controls).

FIG. 3 shows the effect of sample volume on the limit of detection. A) Six different volumes of mouse IgG (7 pM) were compared to samples containing 5 mg/ml of BSA (negative control). Each data point represents the average of 10 spots from two independent experiments. The cut off for the limit of detection (dashed line) was calculated from 3× the standard deviation of the negative controls, incremented by the mean. The six intensities at 7 pM were each connected to the average negative control value with a linear line. B) The limit of detection for each of the 10 replicates was calculated independently and the average and standard deviation are plotted against the injected volume.

FIG. 4 shows pictures of blood samples of different volumes after centrifugation (A) and a dose response curve for detecting rabbit IgG spiked into blood (B). A) Comparing the plasma available after spinning 5 μl of blood to 5 μl of blood diluted with PBS. While the supernatant on the left image is easy to separate from the pellet, the supernatant on the right is barely visible. B) The dose response curve is the average of four independent experiments. In individual experiments each concentration of rabbit IgG is repeated three times. The dotted line is the cut-off for the limit of detection, calculated from 3× the standard deviation of 12 negative controls (blood only) incremented by the mean.

FIG. 5 shows a dose response curve for detecting TNF-α spiked into blood. The curve is the average of three independent experiments. In each experiment the concentrations are repeated three times. The dotted line is the cut-off for the limit of detection, calculated from 3× the standard deviation of 9 negative controls (blood only) incremented by the mean. The concentrations represent the amount of recombinant human TNF-α spiked into blood and assume the native concentration is negligible.

FIG. 6 shows an example of multiplexed detection in blood. A) Schematic showing how the layers of nitrocellulose were assembled (side view) and how the three different samples (anti-rabbit IgG Alexa Fluor 488, anti-mouse IgG Alexa Fluor 488 and both combined) were injected into the device (top view). The injection pattern was designed to form an 'R' on the rabbit layer and an 'M' on the mouse layer. B) The fluorescence images show the sample and analyte multiplexing.

FIG. 7 shows images comparing the adsorption of anti-mouse IgG Alexa Fluor 488 using three different techniques. A) Functionalisation by shaking. Anti-mouse IgG (100 μg/ml, 150 μl) was passively adsorbed on the exposed nitrocellulose spots during an hour long incubation step. B) Functionalisation by centrifugation. Anti-mouse IgG (20 μg/ml, 10 μl) was pulled through the patterned nitrocellulose at 201×g (12 min). C) Functionalisation by spotting. Anti-mouse IgG (400 μg/ml) was manually spotted using low-bind pipette tips (0,2 μl per spot). Please refer to the section, "FoRe Microarray Device Assembly" in the Examples for additional details.

FIG. 8 shows an example of an inlet part. A) A side view of the stack before clamping. The different layers are intentionally separated for clarity. B) A top view of the larger inlet wells micro-machined in PMMA (1.3 mm diameter). C) One channel filled with food dye to illustrate the sample flow from the large inlet wells through the angled 500 μm PDMS inlet channels to the top layer of nitrocellulose.

FIG. 9 shows an example of three inlet designs. A) The inlet reservoir volume was increased by stacking additional layers of PDMS and PMMA. The tapered inlets in the top PMMA layer (700 μm top to 500 μm bottom) fit a pipette tip for manual injection. B) Additional layers of PDMS and PMMA can be added to increase the sample volume to 6 μl C) The angled channel inlet system for up to 12 μl of sample. The PMMA wells (1.3 mm in diameter) can be easily enlarged to increase the reservoir volume.

FIG. 10 shows dose response curves of a sandwich assay detecting mouse IgG. Six different volumes of 1000 pM and 500 pM mouse IgG were analysed, ranging from 1 μl to 6 μl (in 1 μl increments). This resulted in the amount of antigen analysed overlapping for the two concentrations. The curves highlight both the sensitivity of the system to antigen amount (instead of concentration) and the large dynamic range (the system has not saturated with 1 ng of the antigen). The data points are the average of three replicates, except for the negative control, which is the average of six spots injected with 6 μl of 1 mg/ml BSA. The error bars are the standard deviation.

FIG. 11 shows an example fluorescence image of a rabbit IgG concentration series. Concentrations from (2) 6,7 pM to (7) 7,9 fM were analysed in triplicate. The reference spot (1) is 694 pM and the negative control (blood only) is indicated by (8).

EXAMPLES

Volume Dependency.

Figure 2A:
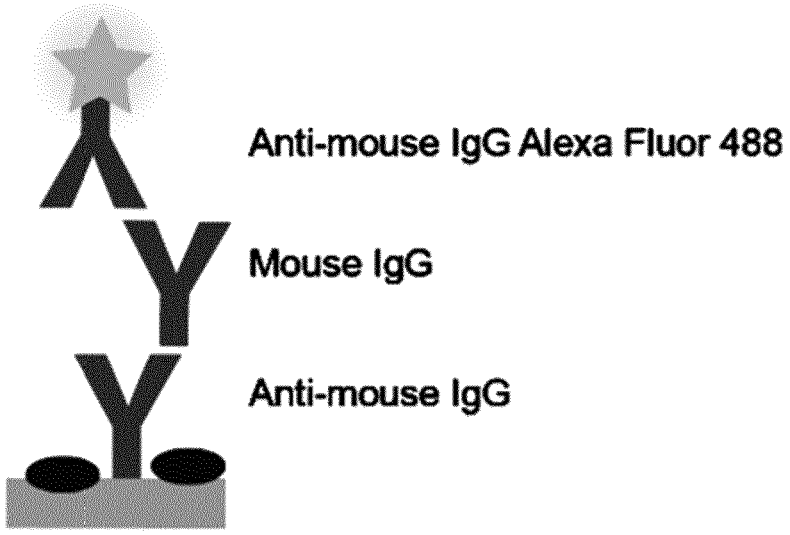
Figure 2A:
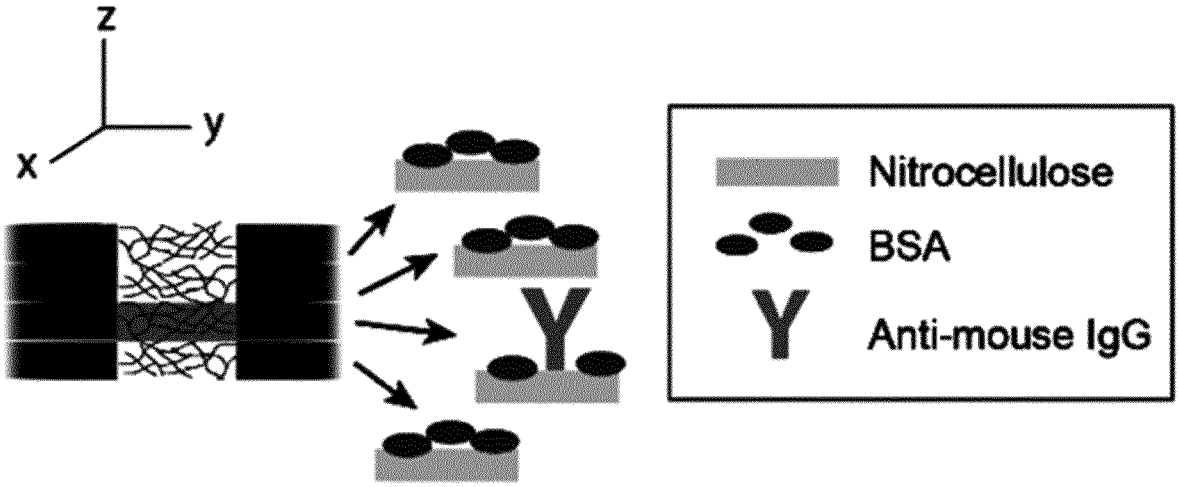
Figure 2B:
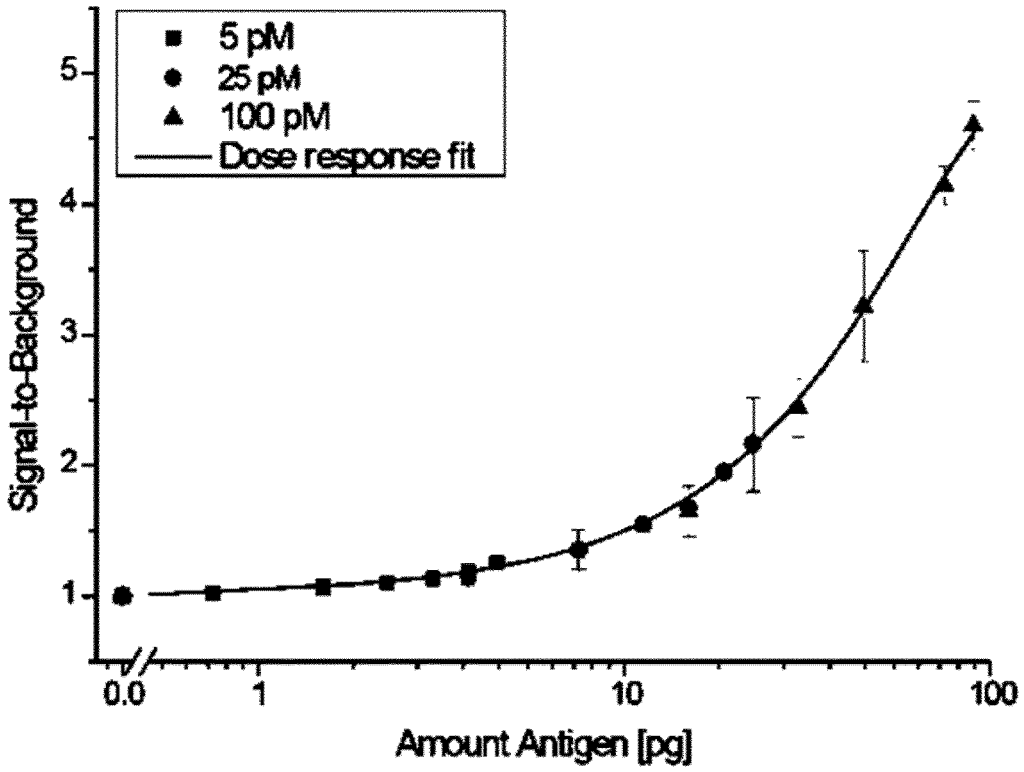
Figure 10:
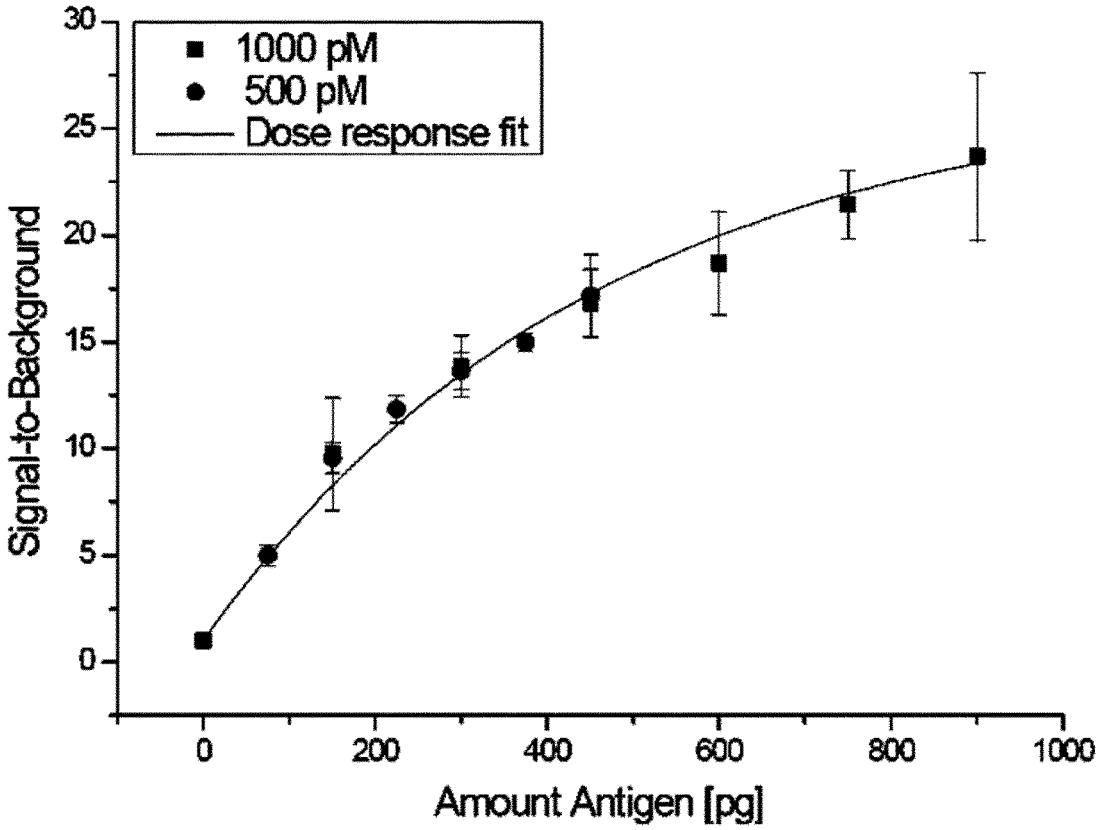

A sandwich assay using different sample volumes demonstrated that the FoRe array captures all the analyte as it flows through the layers. The stack was assembled as shown in FIG. 2A; the third layer was functionalised with anti-mouse IgG and the two layers above and one layer below were blocked with BSA. Three experiments were performed, each with a different concentration of mouse IgG (i.e. 5 pM, 25 pM, or 100 pM) spiked into 1 mg/ml of BSA to represent the high abundance serum proteins. For a given experiment, each volume (1 to 6 μl, in 1 μl increments) was injected in triplicate and the negative control consisted of six spots exposed to 6 μl of 1 mg/ml BSA (three for the 5 pM sample). These three concentrations were chosen because in a system sensitive to antigen amount the curves overlap in this volume range (i.e. 5 μl of 5 pM equals 1 μl of 25 pM and 4 μl of 25 pM equals 1 μl of 100 pM). After manually injecting the samples, the device was spun at 129×g for 12 min to ensure that all the liquid passed through the nitrocellulose. The third layer was then incubated in anti-mouse IgG Alexa Flour 488 before imaging. The three overlapping curves in FIG. 2B demonstrate that the device is sensitive to the total antigen amount. While these results only illustrate that we always capture the same proportion of the analytes passing through the membranes (independent of concentration), because of the high excess of capture probes the most plausible explanation is that all of the analytes are captured in the array spot. The high binding capacity also results in a large dynamic range and we could inject 6 μl of a 1000 pM solution without reaching saturation (FIG. 10).

Figure 2C:
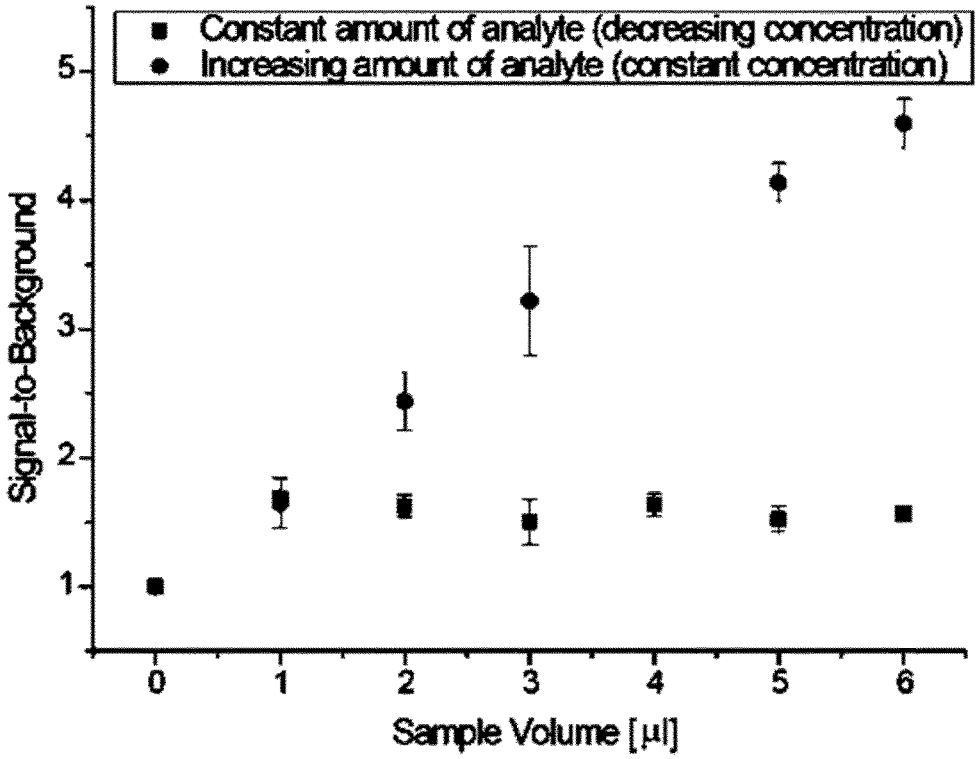

We tested the influence of dilution on the amount of captured antigen (FIG. 2C). Again we used the four-layered stack and sandwich assay presented in FIG. 2A. The 100 pM sample of mouse IgG was diluted in BSA (100 pM to 17 pM) and the injected volume was adjusted to keep the amount of mouse IgG in each sample constant (i.e. we injected 2 μl of the sample diluted 2×, 3 μl of the sample diluted 3×, etc.). The six injected volumes ranged from 1 to 6 μl. In FIG. 2C we compare this result to a 100 pM sample where the concentration was kept constant but the volume increased at the same rate as for the dilution series. The dilution series plateaus at 100 pM and the constant concentration series continues to linearly increase. This result indicates that dilution does not affect the sensitivity of the FoRe array, as long as we increase the sample volume by the same factor.

Improving the Sensitivity.

Figure 3:
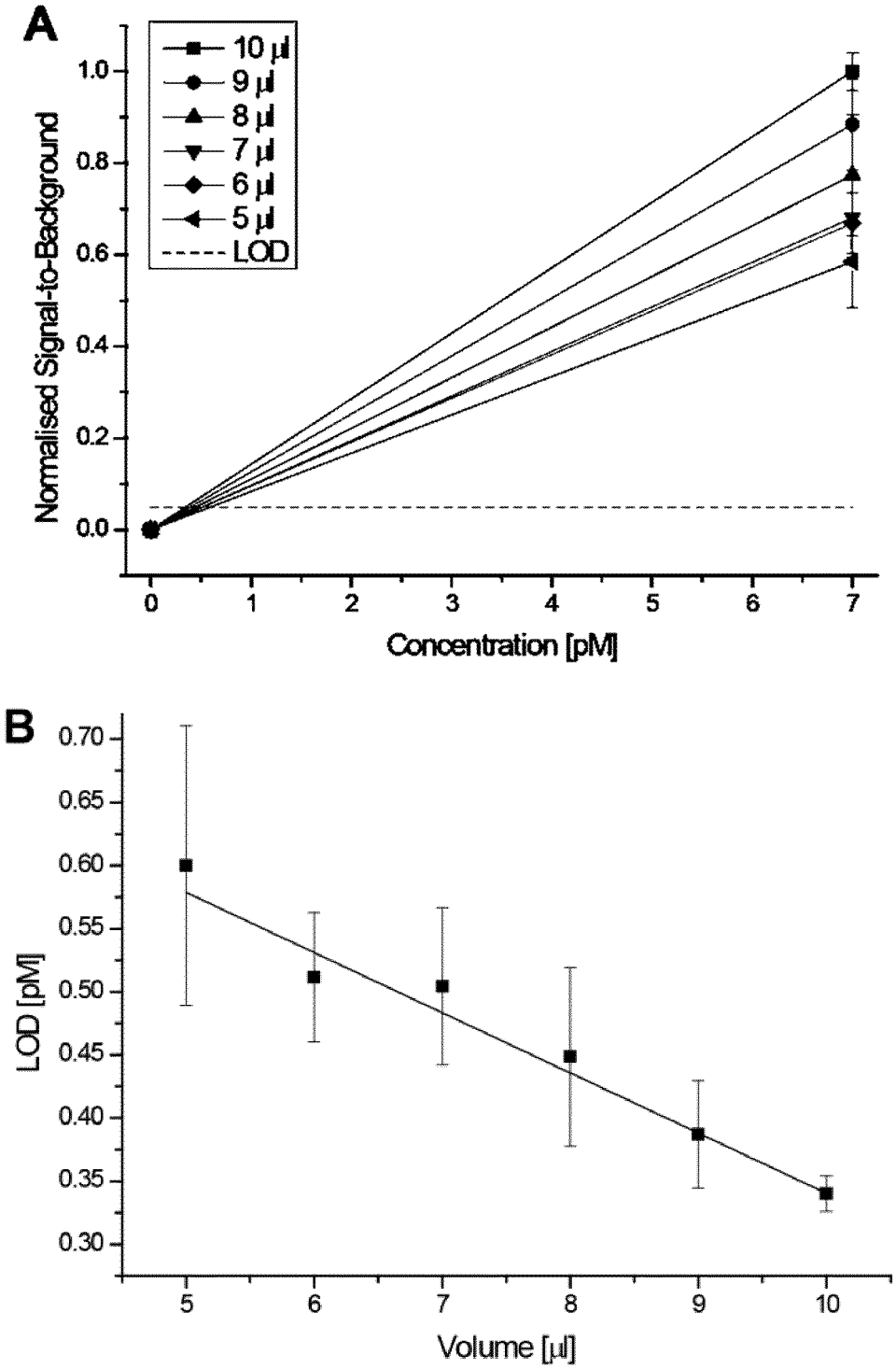

By capturing all the analyte in a sample the FoRe array is uniquely able to tailor the sensitivity based on the sample volume. FIG. 3 shows how the limit of detection (LOD) decreases with increasing sample volume. We assembled a four layer stack, where the third slice was functionalised with anti-mouse IgG and the other three were blocked with BSA. For these experiments we used the angled inlet channels (FIG. 1B) to increase the sample volume to 10 μl. Mouse IgG (7 pM) was spiked into 5 mg/ml of BSA and six volumes from 5 μl to 10 μl were injected into the device. The FoRe array was centrifuged at 201×g for 12 min before incubating in anti-mouse IgG Alexa Flour 488. Each volume is represented by 10 spots from two independent experiments, and the average and standard deviation for the six different volumes are plotted in FIG. 3A. The cut-off for the limit of detection was calculated by taking the average signal of the 10 negative controls (channels injected with only BSA) increased by 3× its standard deviation. To determine the LOD for a given volume, we plotted the 10 normalised data points and fit each with linear line from the value at 7 pM to the negative control. We determined where each fit intersected with the limit of detection line. For each volume the average and standard deviation of the LOD concentrations are plotted in FIG. 3B. As expected, for the factor two increase in volume the sensitivity of the system also increased by a factor of ~2 (1,76±0,33).

Analysis in Complex Samples.

Figure 4:
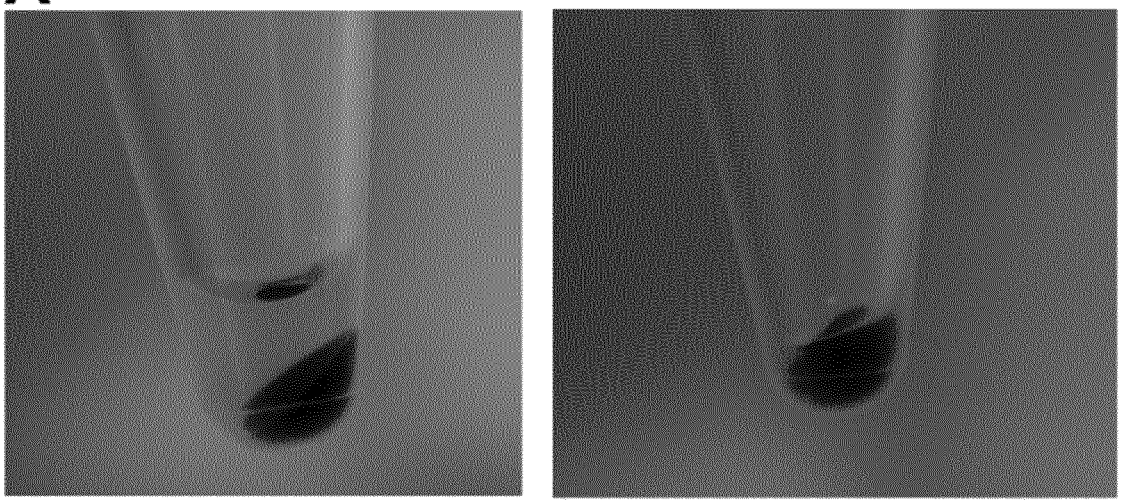
Figure 4:
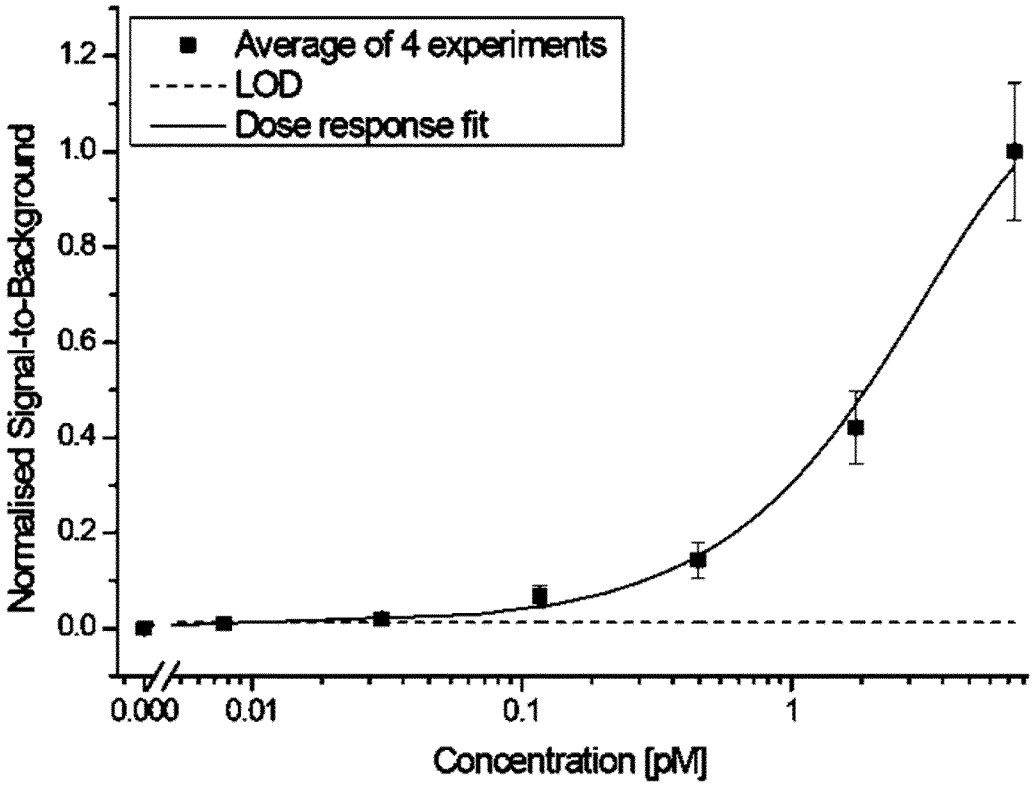

The FoRe microarray is compatible with whole blood analysis using a simple dilution trick. Without pre-processing, viscous or complex samples rapidly clog the nitrocellulose membranes, preventing the samples from flowing through and inducing leaking between the layers. While plasma readily flows through the device (de Lange & Vörös, 2014, *Anal Chem* 86(9), 4209-4216), the cells in whole blood are too large to pass through the 0.45 μm pores (data not shown). Plasma separation membranes (e.g. the Vivid™ Plasma Separation Membrane, Pall Corporation) have been successfully incorporated into 3D paper-based analytical devices for multiplexed analysis from a finger prick of whole blood (Vella et al., 2012, *Anal Chem* 84(6), 2883-2891). However, these membranes can only process 50 μl of blood per $cm^2$, and with the small microarray test sites this would limit our device to ~100 nl sample volumes. In another approach, Ge et al. mixed whole blood with an agglutination factor and used the top layer of cellulose to filter out the large multi-cellular aggregates (Ge et al., 2012, *Lab Chip* 12(17), 3150-3158). This was also not possible with our micron channels as the blood cells quickly blocked the membranes during filtration and the plasma could not pass through. Pre-separating the blood cells from plasma is very challenging in the ~4 μl volume attained from an infant heel prick (Vella et al., 2012, *Anal Chem* 84(6), 2883-2891). However, as we anyway capture everything that passes through the layers we are allowed to dilute the blood with buffer, and easily separate the larger volume of diluted plasma from the blood cells (FIG. 4A). Then passing the entire supernatant through the device is equivalent to analysing the smaller volume of undiluted plasma.

Figure 11:
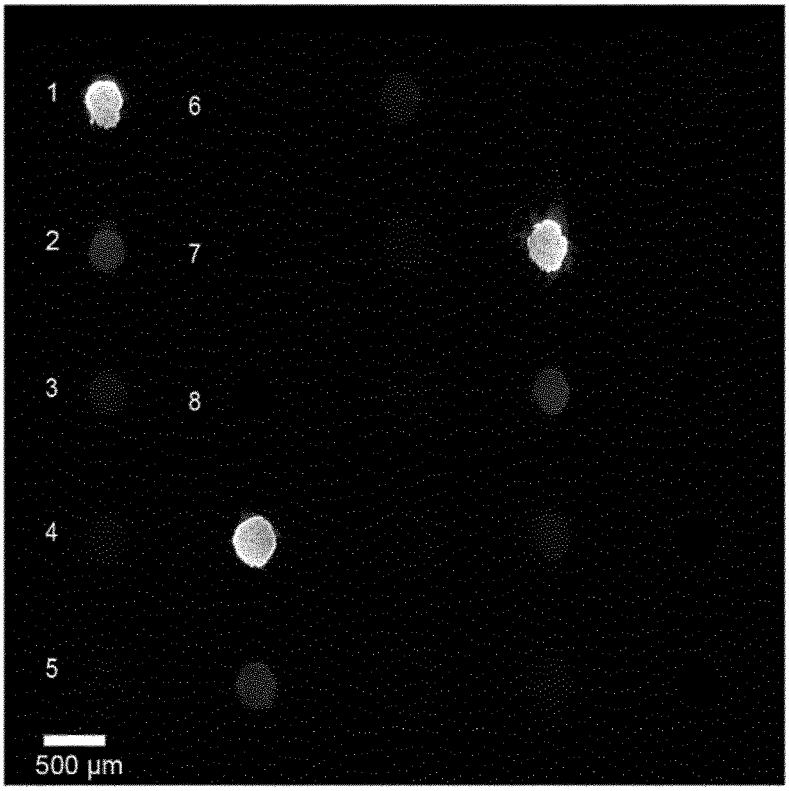

We demonstrated this concept with a sandwich assay detecting rabbit IgG spiked into whole blood. The FoRe array was assembled using the angled inlet channels and four layers of functionalised nitrocellulose (i.e. BSA, BSA, anti-rabbit IgG, BSA). Six concentrations of rabbit IgG ranging from 6,7 pM to 7,9 fM were spiked into blood. We then mixed 5 μl of each concentration with 10 μl of PBS. The samples were spun at 14 100×g for 3 min to separate the blood cells. We injected 10 μl of the supernatant into the device and centrifuged the samples through the nitrocellulose layers (201×g for 12 min). Each concentration was analysed in triplicate for a given experiment and the dose response curve in FIG. 4B is the average of four independent experiments (see FIG. 11 for the fluorescence image). The LOD was 21 fM, calculated by taking the average signal of 12 negative controls (blood samples without spiked in rabbit IgG) increased by 3× its standard deviation. For three of the experimental repeats the functionalisation was done by passively adsorbing the capture antibodies during an hour long incubation step with gentle shaking. The functionalised slice for the fourth repeat was prepared by flowing the capture antibody through the patterned nitrocellulose (as described in the Experimental Methods section). There was no noticeable difference in the dose response curve from this experiment, indicating that flow-through functionalisation is a feasible alternative. This is advantageous both to reduce the cost of expensive reagents and when the capture antibody buffer is not compatible with wax printing techniques (e.g. contains a surfactant which compromises the hydrophobic barriers) (Deiss et al., 2014, *Angewandte Chemie* 53(25), 6374-6377).

Figure 5:
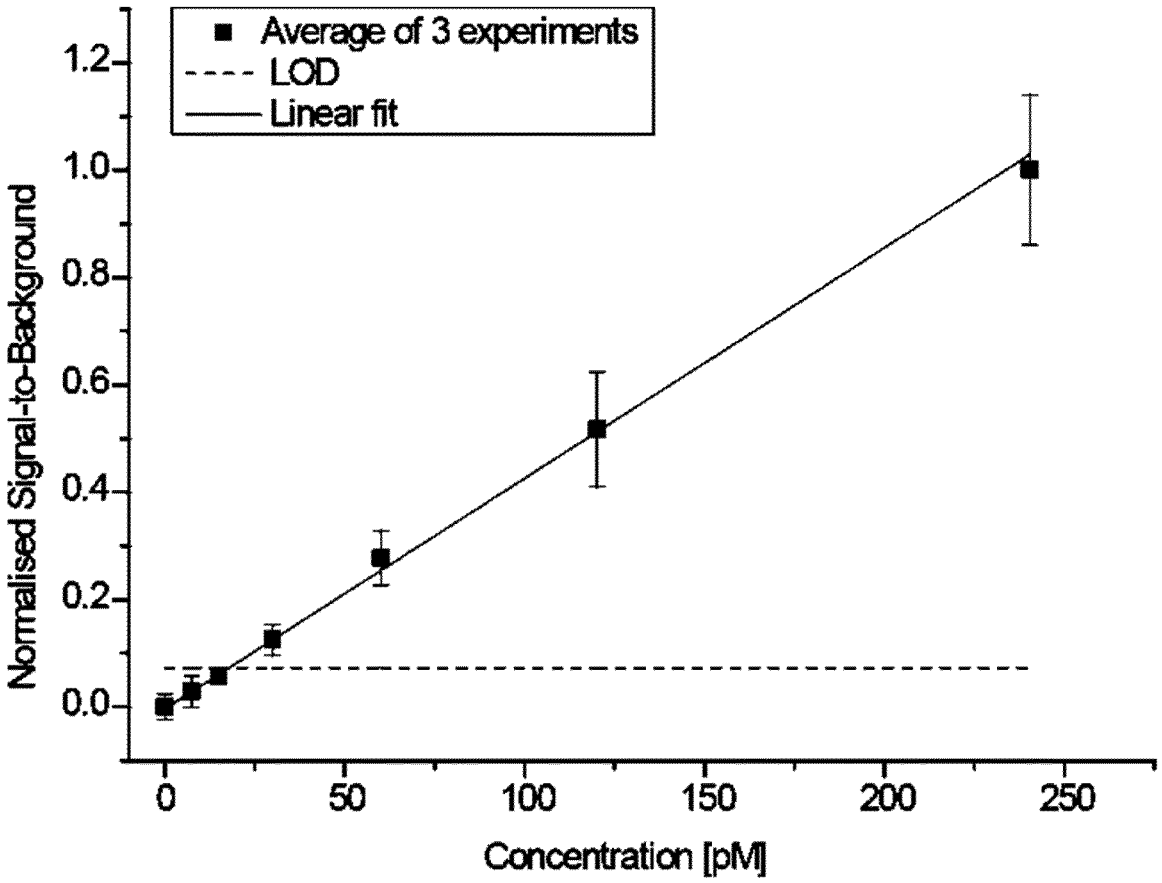

We demonstrated the importance of flow-through functionalisation with a sandwich assay detecting TNF-α. The capture probe was provided in liquid, and the storage buffer was not compatible with passive functionalisation. When the anti-TNF-α capture antibody was passively adsorbed on the surface we observed considerable leaking on the functionalised slice after running the assay. To better control the flow, 1-mm thick PDMS pieces with an array of holes matching the wax pattern were placed above and below the anti-TNF-α layer. However, this only prevented leakage when we switched to the flow-through functionalisation. We functionalised the layers by spinning 1 μl (200 μg/ml) of anti-TNF-α through one layer of nitrocellulose (129×g, 3 min). The nitrocellulose was rinsed in 1 ml of arraying buffer (5 min, gentle shaking), dried first under a stream of nitrogen and then for 1 h at 37° C. The layer was blocked with BSA as described in the Experimental Methods section. The functionalised slice was placed in the second position of a four layer stack. Six concentrations of TNF-α (240 pM to 7,5 pM) were spiked into blood and processed as described above for the rabbit IgG sandwich assay, using TBS instead of PBS as the dilution buffer. The device was spun at 201×g for 15 min (3 min longer than usual) because of the extra PDMS layers. FIG. 5 is the dose response curve for three independent experiments detecting TNF-α. The concentrations represent the amount of recombinant human TNF-α added to the whole blood, and we assumed that the native concentration (~pg/ml) was negligible in this range. The limit of detection was 18 pM, calculated by taking the average signal of 9 negative controls (blood samples without spiked in TNF-α) increased by 3× its standard deviation. The differences in the sensitivity of the device for the different analytes (i.e. mouse IgG, rabbit IgG or TNF-α) can be attributed to differences in the binding affinities, which is also illustrated by the shape (i.e. the position of the inflection point) of the dose-response curves.

We used a direct labelled assay to demonstrate target multiplexing in blood. While the binding of target proteins can suffer from the presence of a label and introducing a detection antibody improves the specificity (Hartmann et al., 2009, *Anal Bioanal Chem* 393(5), 1407-1416), the assay is faster (one incubation step is eliminated) and less expensive (Wilson, R., 2013, *Expert Rev Proteomics* 10(2), 135-149). The direct-labelled assay is well-suited to our multiplexing experiment because it allows us to directly visualise the target binding and highlights the compatibility of the device with different immunoassays.

Figure 6:
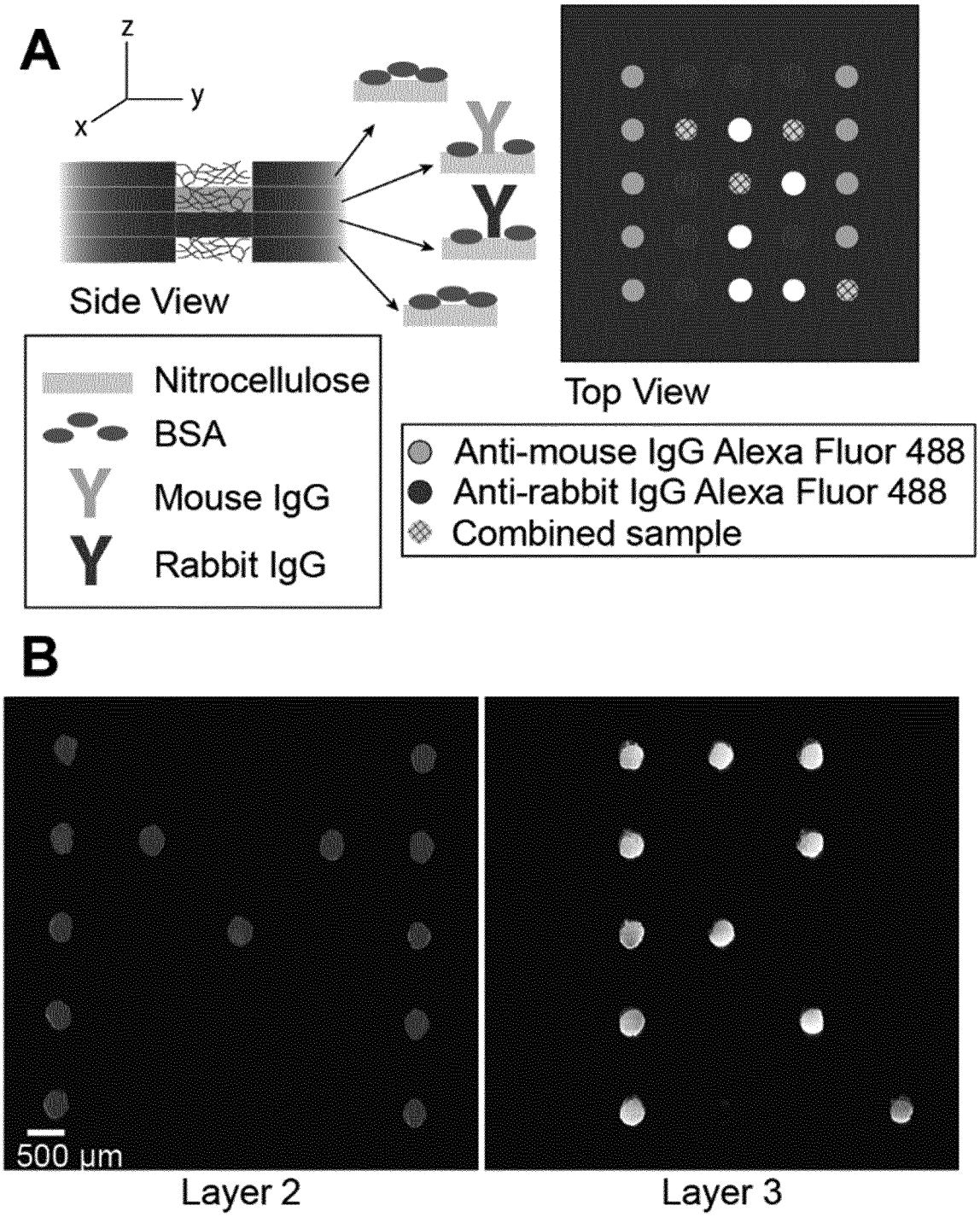

The layers in the stack were functionalised with: BSA, mouse IgG, rabbit IgG, and BSA (FIG. 6A). The three sample solutions were anti-mouse IgG Alexa Fluor 488 (5 μg/ml), anti-rabbit IgG Alexa Fluor 488 (5 μg/ml), or a combined sample (5 μg/ml of each) spiked into blood. As before, each channel analyses 5 μl of blood, diluted with 10 μl of PBS. The samples were spun at 14 100×g for 3 minutes and 10 μl of the supernatant was injected following the pattern shown in FIG. 6A. The samples containing anti-mouse IgG should bind to layer 2, the anti-rabbit IgG to layer 3 and the combined sample to both layers. The pattern from the sample injection forms an 'R' on the rabbit layer and an 'M' on the mouse layer. The fluorescence images in FIG. 6B clearly show that the FoRe array is capable of multiplexed analysis in blood; the mouse and rabbit samples bound specifically to the correct layers and the combined samples appeared on both layers with no obvious loss of intensity.

Detailed Description of the FIGS. 12 to 18.

Figure 12:
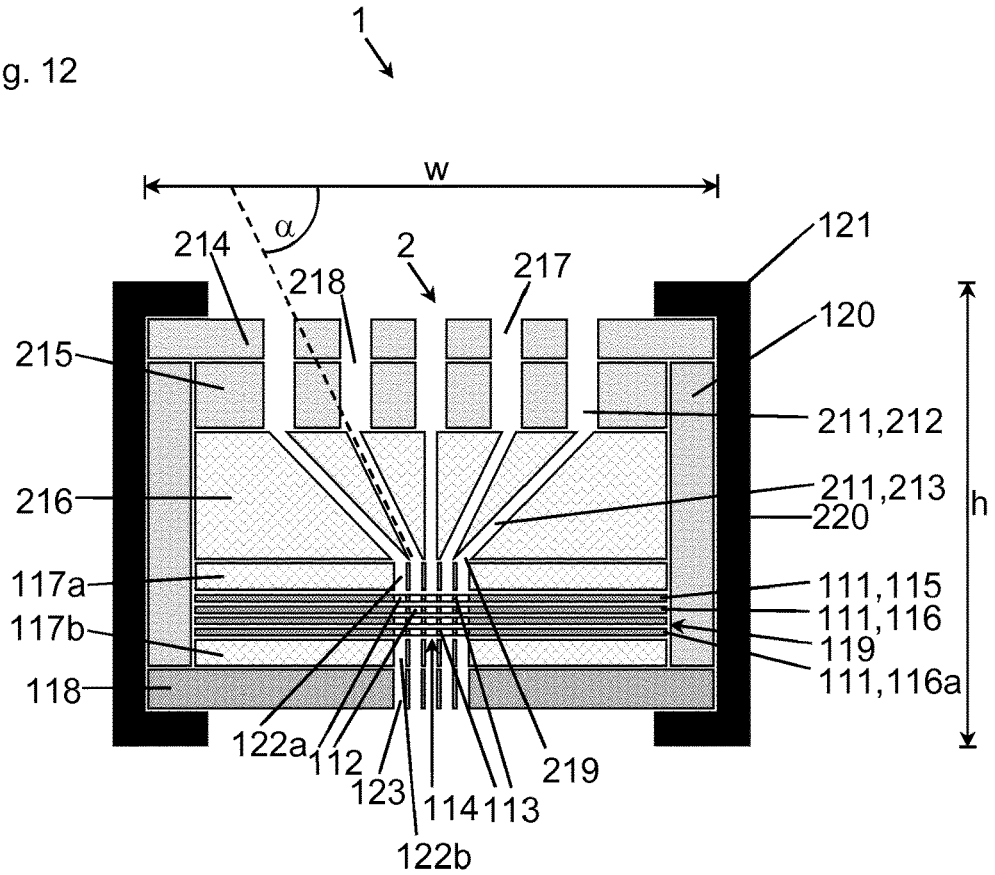
FIG. 12 shows a cross-section of a device for analysing liquid samples in an embodiment with angled connecting sections of the inlet channels.

FIG. 12 shows a cross-section of a device 1 for analysing liquid samples in an embodiment with angled, connecting sections 213 of the inlet channels 211.

The device 1 comprises a top plate 214 with an array of top plate openings 217, each large enough to fit a pipette tip. A reservoir part 215 comprising an array of reservoir sections 212 is positioned directly below the top plate 214, such that each opening 217 overlaps with a respective reservoir section 212.

A connecting part 216 is arranged below the reservoir part 215. The connecting part 216 comprises an array of connecting sections 213, which are arranged such that the top part of each connecting section 213 overlaps with a respective reservoir section 212 of the reservoir part 215, wherein a respective inlet channel 211 is formed from each connecting section 213 and the respective reservoir section 212. Each connecting section 213 is arranged at an angle α with respect to the plane defined by the at least one sample layer 111, depicted as the width w, wherein the angle α differs from 90° for some connecting sections 213. That is, the connecting part 216 comprises angled sections 220.

The inlet part 2 is comprised of the top plate 214, the reservoir part 215, and the connecting part 216.

The device 1 further comprises a stack of sample layers 119 comprising a top sample layer 115, a second sample layer 116, and a bottom sample layer 116*a*. The stack of sample layers 119 is arranged between an upper sealing part 117*a*, and a lower sealing part 117*b*, which seal the sample layers 111 against leakage. Each sample layer 111 comprises a plurality of liquid permeable test sites 112, and a liquid impermeable barrier region 113, wherein the barrier region 113 separates the test sites 112 of the respective sample layer 111 from each other. The test sites 112 of the sample layers 111 are arranged such that respective test sites 112 of neighbouring sample layers 111 overlap, thereby forming a plurality of sample channels 114 extending through the stack of sample layers 119.

The upper sealing part 117*a* comprises a plurality of upper sealing part openings 122*a*, and the lower sealing part 177*b* comprises a plurality of lower sealing part openings 122*b*. Therein the upper part of each upper sealing part opening 122*a* overlaps with a respective connecting section 213 of the connecting part 216. The lower part of each upper sealing part opening 122*a* overlaps with a respective test site 112 of the top sample layer 115. The upper part of each lower sealing part opening 122*b* overlaps with a respective test site 112 of the bottom sample layer 116*a*.

The device 1 further comprises a frame 120, which is positioned in parallel to the height h, and surrounds the reservoir part 215, the connecting part 216, the upper sealing part 117*a*, the lower sealing part 117*b*, and the stack of sample layers 119. The frame 120 ensures the correct alignment of the parts of the device 1.

The device 1 further comprises a bottom plate 118, which is arranged in parallel to the width w and forms the lower boundary of the device 1. The bottom plate 118 comprises a plurality of outlets 123, wherein each outlet 123 overlaps with the lower part of a respective lower sealing part opening 122*b*.

The device 1 further comprises a clamp or spring-loaded tension lock 121, which is arranged in parallel to the height h, wherein the clamp or spring-loaded tension lock 121 covers the side walls of the device 1, and part of the top and bottom boundaries of the device 1, wherein the top plate openings 217, and the outlets 123 are left open. A mechanical force is applied by means of the clamp or spring-loaded tension lock 121 on the components of the device 1 by the top plate 214 and the bottom plate 118 to ensure sealing of the device 1 to the exterior and avoid leakage of samples.

The device 1 is arranged such that a flow connection between a top plate opening 217, a respective reservoir section 212, a respective connecting section 213, a respective upper sealing part opening 122*a*, a respective sample channel 114, comprising a plurality of test sites 112 of a plurality of sample layers 111, a respective lower sealing part opening 122*b*, and a respective outlet 123 can be established.

Figure 13:
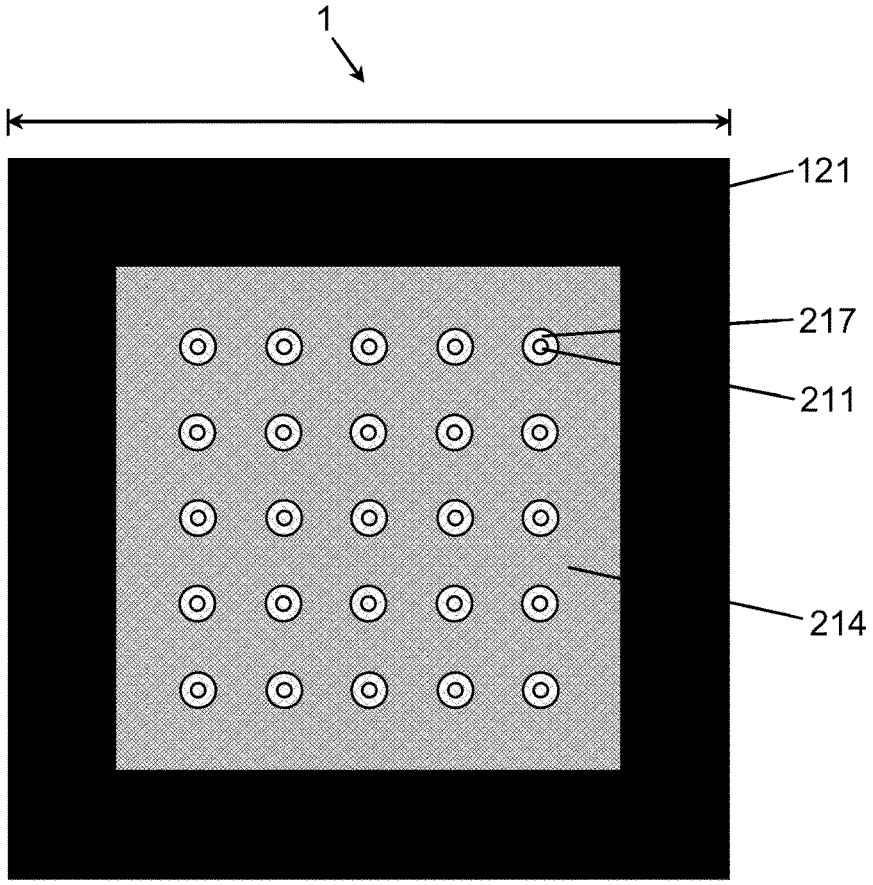
FIG. 13 shows a top view of a device for analysing liquid samples.

FIG. 13 shows a top view of a device 1 for analysing liquid samples. The device 1 is characterised by a width w, and comprises a clamp or spring-loaded tension lock 121, and a top part 214 with a plurality of top plate openings 217. Through the top plate openings 217, the respective inlet channels 211 are visible.

Figure 14:
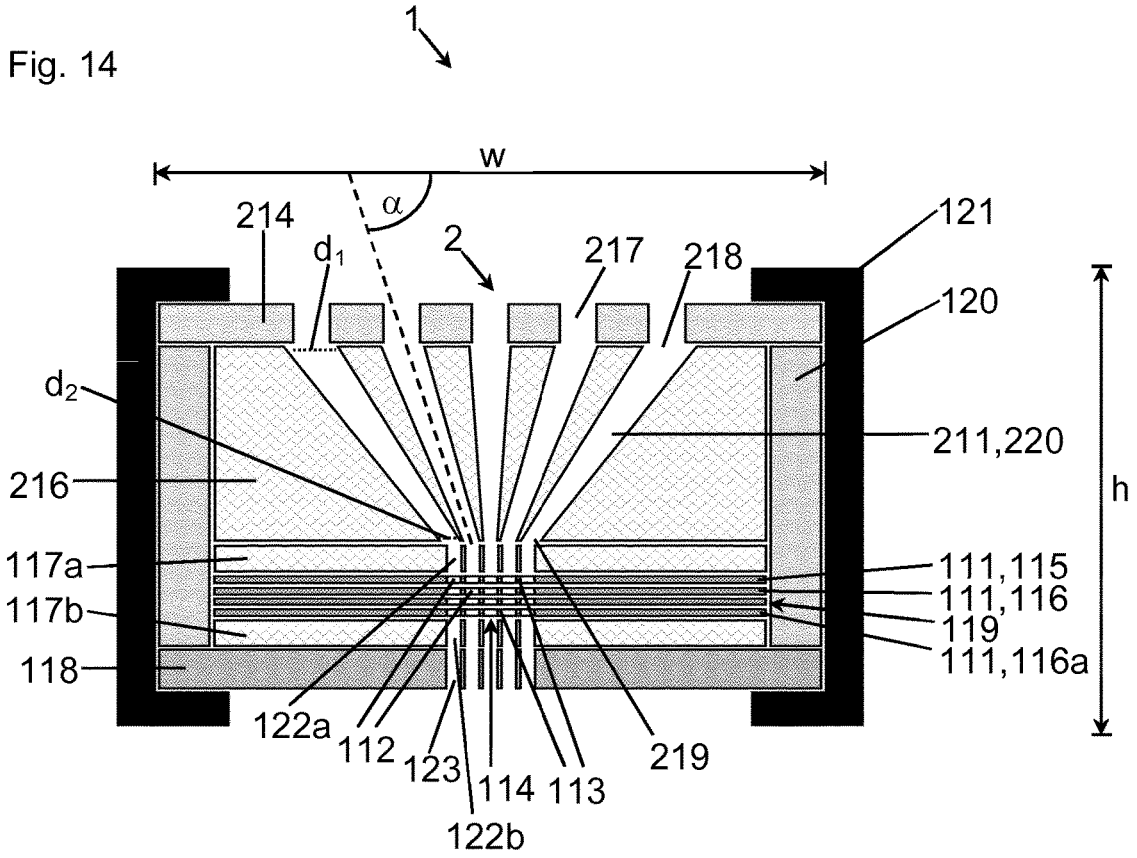
FIG. 14 shows a cross-section of a device for analysing liquid samples in an embodiment with angled, conical inlet channels.

FIG. 14 shows a cross-section of a device 1 for analysing liquid samples in an embodiment with angled, conical inlet channels 211.

The device 1 comprises a top plate 214, an upper sealing part 117*a*, a stack of sample layers 119, a lower sealing part 117*b*, a bottom plate 118, a frame 120, and a clamp or spring-loaded tension lock 121 arranged analogously to the device 1 shown in FIG. 12.

A connecting part 216 is arranged between the top plate 214 and the upper sealing part 117*a*. The connecting part 216 comprises an array of inlet channels 211, which are arranged such that the top part of each inlet channel 211 overlaps with a respective top plate opening 217. Each inlet channel 211 is arranged at an angle α with respect to the width w, wherein the angle α differs from 90° for some inlet channels 211. That is, the connecting part 216 comprises angled sections 220.

The inlet part 2 is comprised of the top plate 214 and the connecting part 216.

Each inlet channel 211 overlaps with a respective upper sealing part opening 122*a* at the bottom part of the connecting part 216, which is positioned adjacent to the upper sealing part 117*a*.

Each inlet channel 211 has a conical shape, wherein the first diameter $d_1$ of the inlet channel 211 at the connection to the respective top plate opening 217 is larger than the second diameter $d_2$ of the inlet channel 211 at the connection to the respective top sealing plate opening 122*a*.

The device 1 is arranged such that a flow connection between a top plate opening 217, a respective inlet channel 211, a respective upper sealing part opening 122*a*, a respective sample channel 114, comprising a plurality of test sites 112 of a plurality of sample layers 111, a respective lower sealing part opening 122*b*, and a respective outlet 123 can be established.

Figure 15:
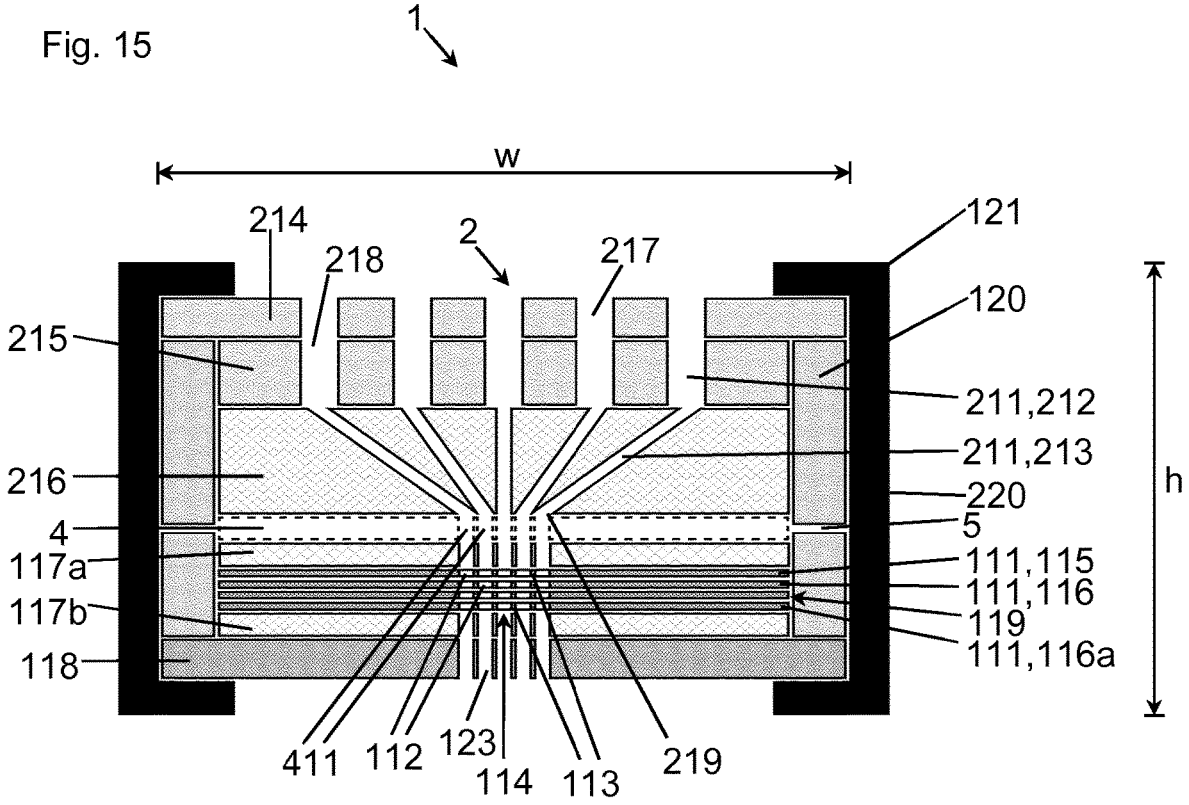
FIG. 15 shows a cross-section of a device for analysing liquid samples in an embodiment with angled inlet channels with an additional built-in hydrophobic membrane and an additional air passage.

FIG. 15 shows a cross-section of a device 1 for analysing liquid samples in an embodiment with angled inlet channels 211 with an additional hydrophobic membrane 4 and an additional air passage 5. That is, the connecting part 216 comprises angled sections 220.

The device 1 comprises a top plate 214, a reservoir part 215, a connecting part 216, an upper sealing part 117*a*, a stack of sample layers 119, a lower sealing part 117*b*, a bottom plate 118, a frame 120, and a clamp or spring-loaded tension lock 121 arranged analogously to the device 1 shown in FIG. 12.

A hydrophobic membrane 4 is positioned between the connecting part 216 and the upper sealing part 117*a*. The hydrophobic membrane 4 comprises a plurality of holes 411, wherein each hole 411 overlaps with a respective connecting section 213 of the connecting part 216, and a respective test site 112 of the top sample layer 115.

The frame 120 comprises an air passage 5 positioned adjacent to the hydrophobic membrane 4, so that air trapped at the hydrophobic membrane 4 may escape through the air passage 5.

Figure 16:
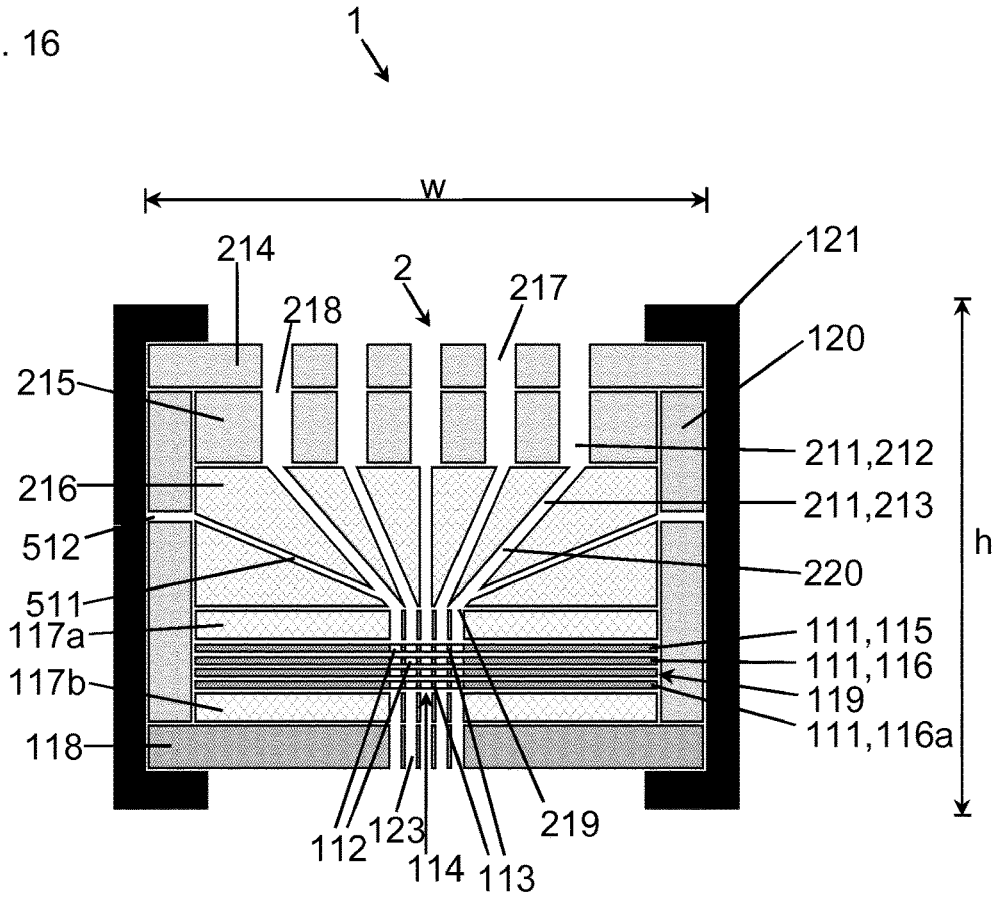
FIG. 16 shows a cross-section of a device for analysing liquid samples in an embodiment with angled inlet channels with additional air passages.

FIG. 16 shows a cross-section of a device 1 for analysing liquid samples in an embodiment with angled inlet channels 211 with additional air passages 511, 512. That is, the connecting part 216 comprises angled sections 220.

The device 1 comprises the parts described for FIG. 12 in an analogous arrangement. The connecting part 216 comprises at least one first air passage 511, wherein the first air passage 511 is connected to at least one connecting section 213 of the connecting part 216 in a flow connection, such that air trapped in the connecting section 213 may escape the connecting section 213 through the first air passage 511. The frame 120 comprises at least one second air passage 512, wherein the second air passage 512 is connected to the respective first air passage 511 and to the exterior in a flow connection, such that air may escape from the first air passage 511 through the second air passage 512 to the exterior.

Figure 17:
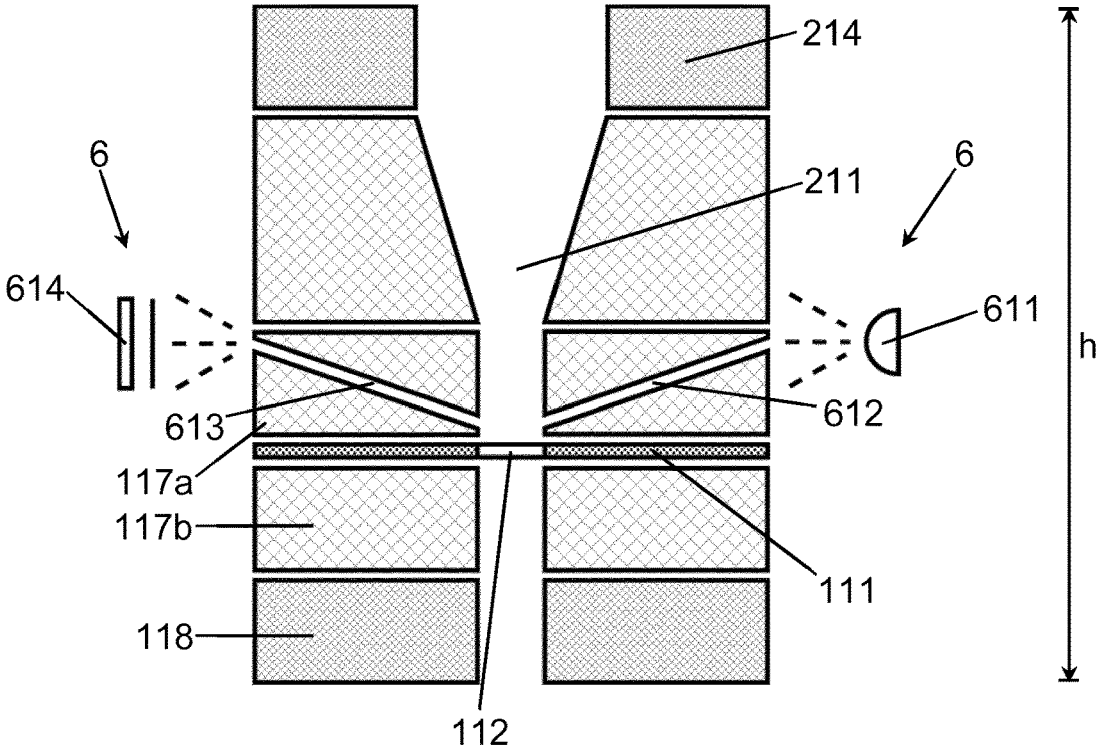
FIG. 17 shows a cross-section of a part of a device for analysis of liquid samples comprising an optical unit.
Figure 18:
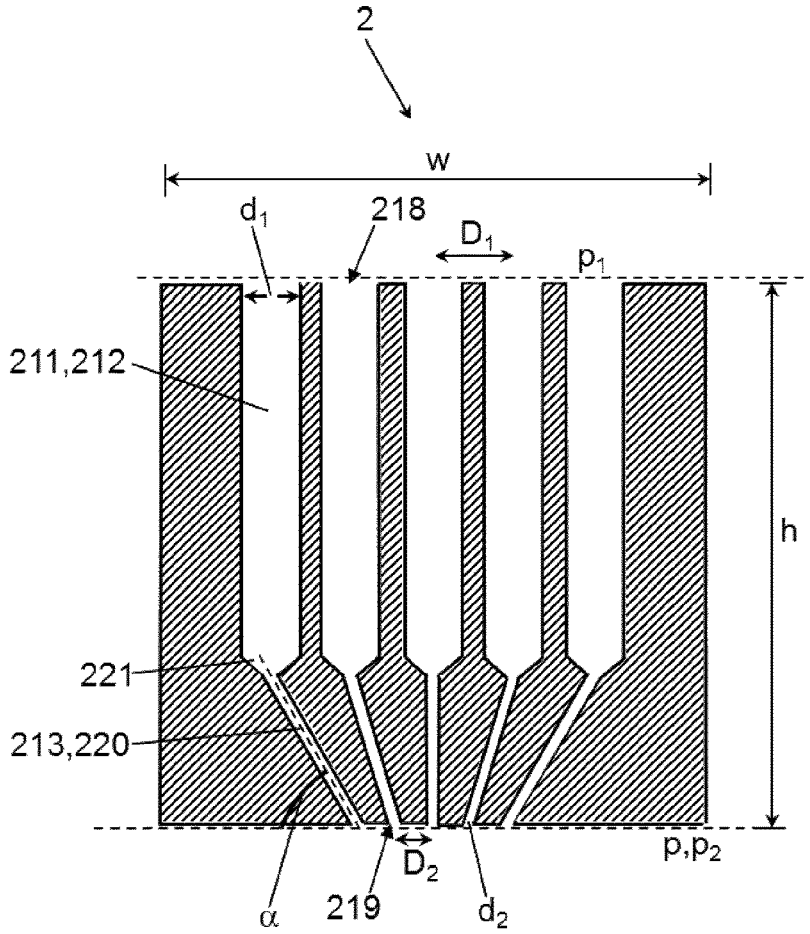
FIG. 18 shows a cross-section of an inlet part according to the invention (A) and a device for analysis of liquid samples (B) in a further embodiment, wherein the inlet channels comprise angled sections.
Figure 18:
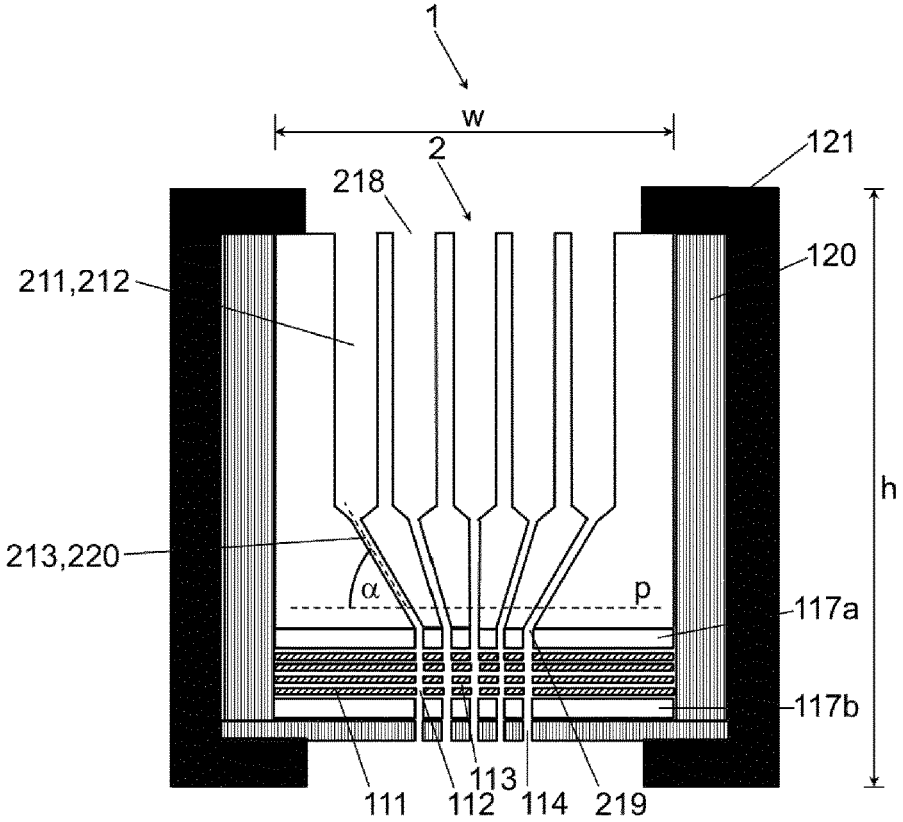

FIG. 17 shows a cross-section of a part of a device 1 for analysis of liquid samples comprising an optical unit 6. The optical unit 6 comprises a light source 611, a first optical fibre 612, a second optical fibre 613, and a photo detector 614.

The light source 611 provides light, particularly excitation light, which is able to excite a fluorophore. The light is guided through the first optical fibre 612 onto the test site 112 of the sample layer 111, particularly such that fluorophores positioned at the test sites 112 are excited. The second optical fibre 613 is positioned such that light provided by a substance at the test site 112, particularly fluorescence light emitted by a fluorophore positioned at the test site 112, travels through the second optical fibre 613 to the photo detector 614, which is adapted to generate a signal in response to light, particularly the light guided by the second optical fibre 613.

FIG. 18A shows a cross-section of an inlet part 2 according to the invention comprising inlet channels 211, which comprise a reservoir section 212 and a connecting section 213, wherein each reservoir section 212 is connected to a corresponding connecting section 213 by means of a conical transition section 221. Therein, the reservoir sections 212 and the connecting sections 213 are incorporated in a single inlet part 2. Five inlet channels 211 are depicted, wherein the connecting sections 213 of the outer four inlet channels 211 are angled sections 220, comprising an angle α of less than 90° with respect to a plane p by the at least one sample layer 111 depicted in FIG. 18B. The angle α is smallest in the outer inlet channels 211 and increases towards the center of the inlet part 2, wherein the connecting section 213 of the center inlet channel 211 is arranged at an angle α of 90° and is therefore not an angled section 220. The reservoir sections 212 are arranged at an angle α of 90°. Furthermore, the reservoir sections 212 comprise a cross-sectional first diameter $d_1$, and the connecting sections 213 comprise a cross-sectional second diameter $d_2$, wherein the first diameter $d_1$ is larger than the second diameter $d_2$, and wherein the diameter decreases in the conical transition sections 221. That is, the first diameter $d_1$ of the respective transition section 221 at the connection to the respective reservoir section 212 is larger than the second diameter $d_2$ of the transition section 221 at the connection to the respective connecting section 213.

Each reservoir section 212 comprises a respective first opening 218 arranged in a first plane $p_1$ parallel to the at least one sample layer 111 at the distal side of the inlet part 2 with respect to the at least one sample layer 111, and each connecting section 213 comprises a respective second opening 219 arranged in a second plane $p_2$ parallel to the at least one sample layer 111 at the proximal side with respect to the at least one sample layer 111, when the inlet part 2 is assembled with the at least one sample layer 111 as depicted in FIG. 18B. As a result of the arrangement of the angled sections 220 and the ratio between the first diameter $d_1$ and the second diameter $d_2$, the centre-to-centre distance $D_2$ of the second openings 219 is smaller than the centre-to-centre distance $D_1$ of the first openings 218. This allows to load large sample volumes, i.e. for diluted samples, into the reservoir sections 212, and to apply the samples to small sample layers 111 comprising a densely spaced arrangement of test sites 112.

FIG. 18B shows a sectional view of a device 1 for analysing liquid samples comprising the inlet part 2 depicted in FIG. 18A as well as further parts to those depicted in FIG. 12 to FIG. 16. The device 1 is assembled in an analogous manner to the devices 1 shown in FIG. 12 to FIG. 16.

The setup shown in FIGS. 18A and B advantageously allows the use of the method for analysing liquid samples according to the invention, wherein essentially the total amount of a component of a diluted complex liquid sample can be captured by means of capture compounds, i.e. antibodies bound to the test sites 112. Furthermore, a small sample layer, particularly having dimensions of 5×5 mm or less advantageously allows to completely scan an entire sample layer at high resolution for optical signal analysis.

Materials and Methods

Materials.

Alexa Fluor 488 anti-mouse IgG (H+L, produced in goat, highly cross-adsorbed), Alexa Fluor 488 anti-rabbit IgG (H+L, produced in goat, highly cross-adsorbed), streptavidin Alexa Fluor 488 conjugate and the TNF-α human antibody pair kit, including anti-TNF-α, biotinylated anti-TNF-α, and recombinant human TNF-α standard (Novex®) were purchased from Invitrogen, Switzerland. The following antibodies were purchased from Sigma-Aldrich, Switzerland: IgG from mouse serum, IgG from rabbit serum, IgG from goat serum, anti-mouse IgG (produced in goat) and anti-rabbit IgG (produced in goat). The 3D array layers were Amersham Premium 0.45 μm nitrocellulose membranes from VWR International, Switzerland. The membranes were functionalised with antibodies prepared in protein arraying buffer from Maine Manufacturing (Kerafast Inc., Boston, USA) and blocked with albumin from bovine serum (≥98%; Sigma, Switzerland). All other protein solutions were prepared in Tris buffered saline (TBS, Sigma, Switzerland), expect those for the TNF-α assays, which were prepared in GIBCO® phosphate buffered saline (pH 7,4; Invitrogen, Switzerland). TBS buffer was purchased either 10× concentrated or as tablets and used after diluting in ultrapure water (Milli-Q gradient A 10 system, Millipore Corporation, Switzerland) and filtrating (0,2 μm). The polydimethylsiloxane (Sylgard 184, Dow Corning) for micro-moulding inlet reservoirs was prepared at a 10:1 ratio with its crosslinker. EDTA-stabilised blood was purchased from Blutspende Zürich (Zurich, Switzerland) and stored at room temperature for up to 1 week from when it was drawn.

FoRe Microarray Device Assembly.

Figure 1:
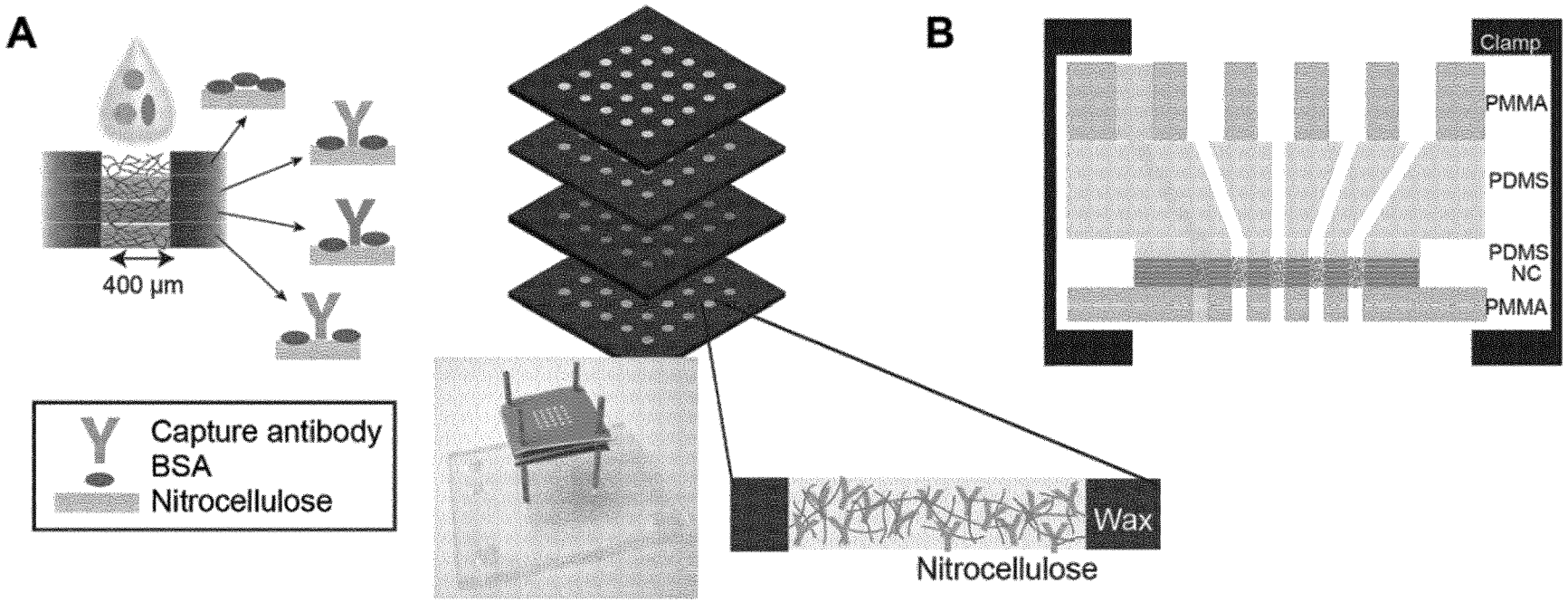

The FoRe array was prepared as described previously (de Lange & Vörös, 2014, *Anal Chem* 86(9), 4209-4216), with the exception of the new inlet design. Briefly, the multiplexed affinity columns are formed by stacking wax-patterned and biofunctionalised nitrocellulose membranes. Hydrophobic wax barriers surround the antibody-loaded spots on each layer, allowing liquid to pass through vertically while isolating samples from each other laterally (FIG. 1A). The wax is printed with a solid ink printer (ColorQube 8570, Xerox, Switzerland) and quickly melted in an oven (125° C., 2 min) to extend the liquid barrier through the thickness of the porous nitrocellulose (Lu et al., 2010, *Anal Chem* 82(1), 329-335). Please note that nitrocellulose is highly flammable and has a flash point of ~200° C. The microarrays consist of 25 spots, arranged in a 5×5 square. Each spot is approximately 400 μm in diameter with 1.2 mm centre-to-centre spacing.

After wax patterning, the nitrocellulose layers are functionalised by passively adsorbing the capture probes. A capture antibody solution of 100 μg/ml was prepared in protein arraying buffer. We added 150 μl of the capture antibody solution to a 6-mm polydimethylsiloxane (PDMS) reservoir above the array and incubated the slices for 1 h on a rotary shaker. The slices were rinsed briefly with arraying buffer (150 μl, 5 min, gentle shaking) and dried under a stream of nitrogen. To improve protein adhesion, the slices were left at 37° C. for 1 h. The remaining binding sites were blocked with 1% (w/v) bovine serum albumin (BSA) to prevent nonspecific adsorption to the nitrocellulose (1 ml of BSA, 30 min, gentle shaking). The layers were then rinsed twice with TBS (1 ml, 10 min) and once with Millipore water (1 ml, 5 min). The slices were dried with nitrogen and stored for short term at room temperature and for longer at 4° C.

Figure 7:
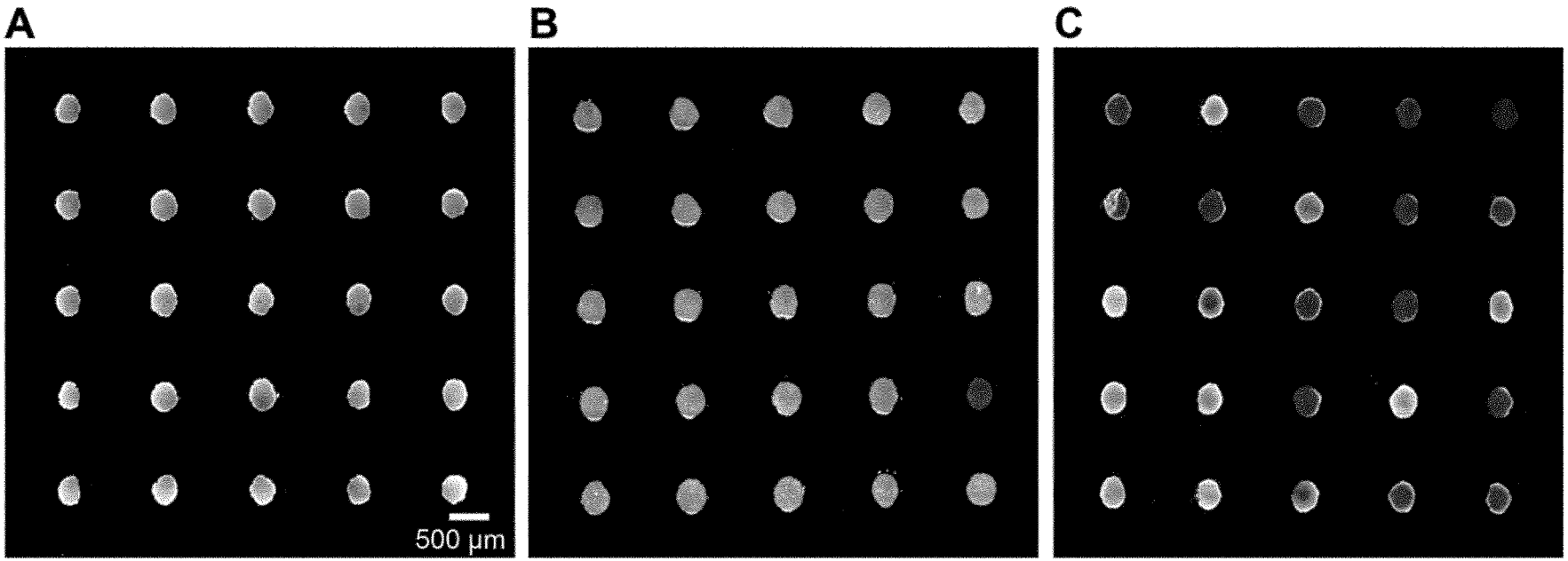

We investigated two other functionalisation approaches to reduce the required amount of capture antibody (see FIG. 7 for more details). We functionalised the slices by manually spotting 0,2 μl (400 μg/ml) of the capture antibody on each spot; however, this resulted in highly variable amounts on each test site. Slices were also functionalised by assembling a one layer stack and flowing 10 μl (20 μg/ml) of the capture antibody solution through the channels (12 min, 201×g) before the standard 1 h drying and blocking steps. The capture probe distribution was more uniform and comparable to the bulk approach presented above.

Figure 8:
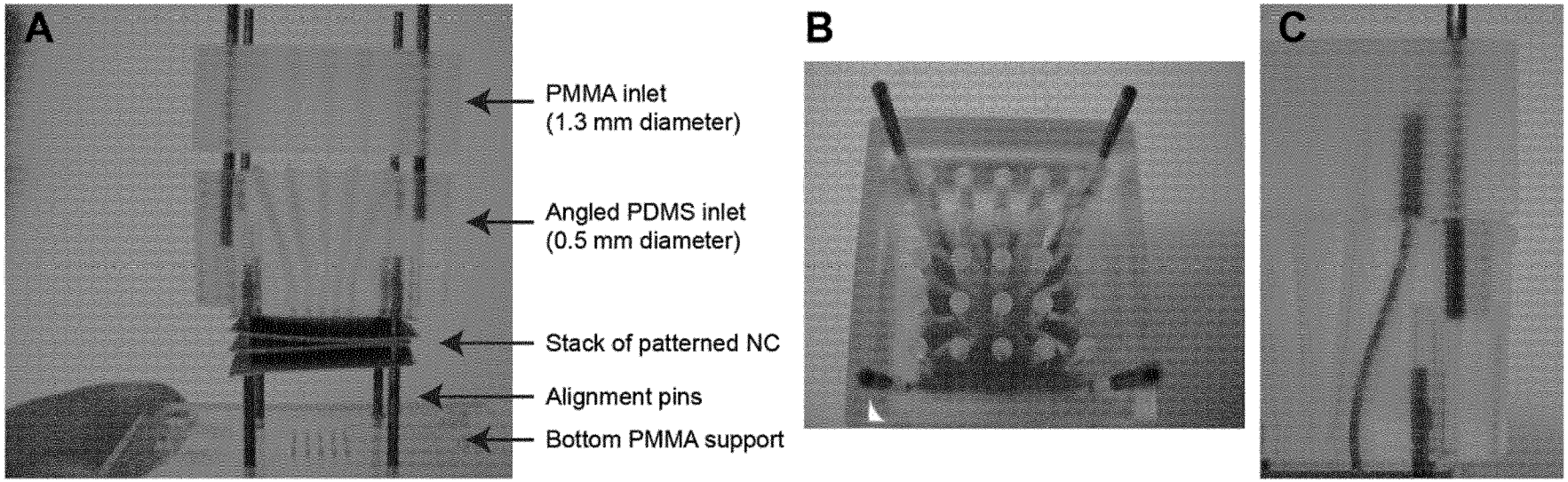
Figure 9:
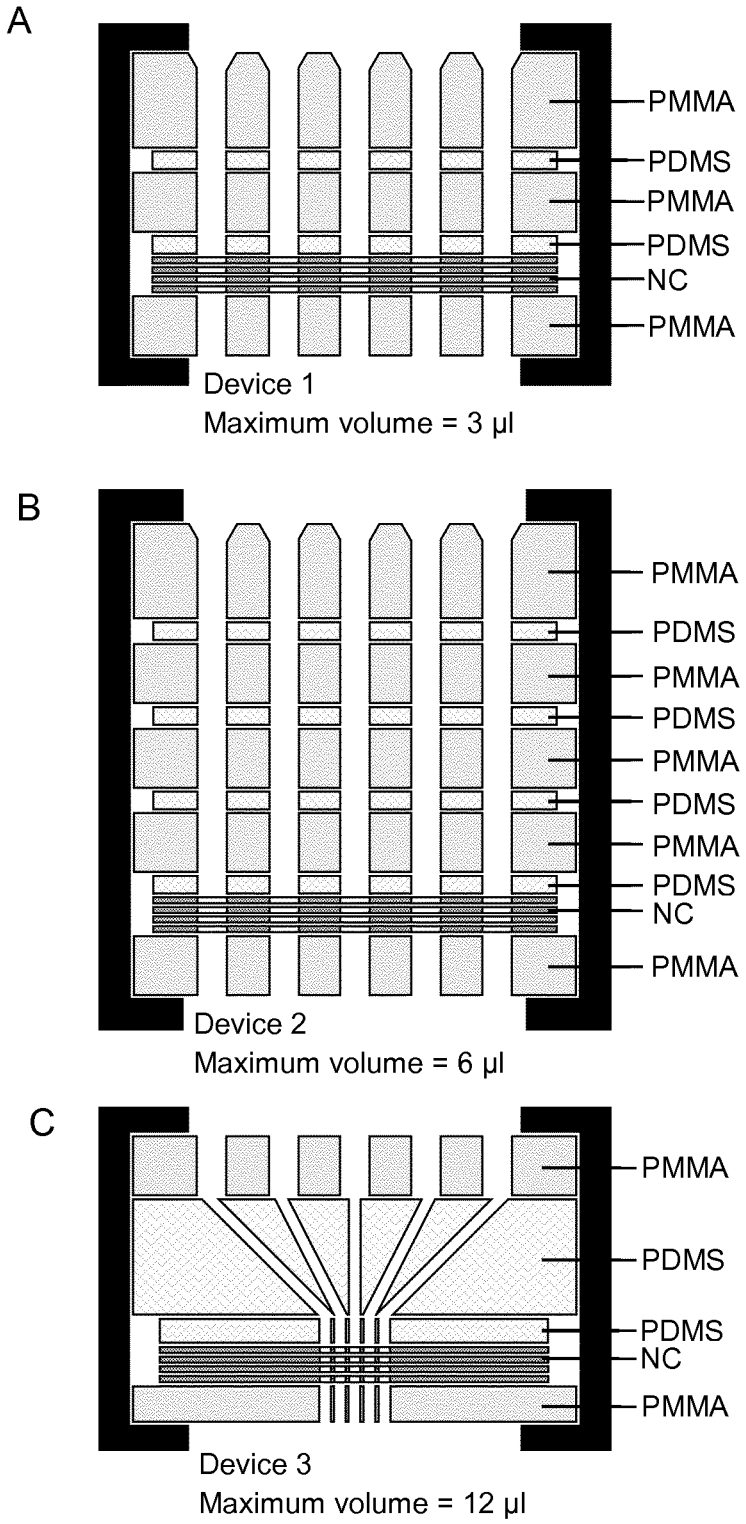

To align the slices, four holes are punched out of the nitrocellulose with a biopsy punch (KAI biopsy punch, Medical-Impex, Germany) and the layers are stacked with the aid of four, 1 mm-diameter pins (FIG. 1A). The stack of nitrocellulose is clamped between micromachined poly(methyl methacrylate) (PMMA) inlet and outlet pieces. A PDMS layer, with an array of angled 500 μm-diameter channels connects the wax pattern on the nitrocellulose with the larger wells (1.3 mm diameter) in the PMMA inlet (FIG. 1B). This novel design makes it possible to increase the sample volume without making the device impractically tall or compromising the high spot density (FIG. 8 for device pictures). We also fabricated an inlet array with vertical 500-μm channels, which was used for testing volumes in the range of 1 to 6 μl (FIG. 9). In the first version, inlet channels were 18 mm tall and injection was done in two steps with a GELoader pipette tip (used in FIG. 2C). The second version increased the channel height to 31 mm, assembled in several parts, to inject up to 6 μl (used in FIG. 2B).

Immunoassays.

The device tests 25 independent samples for a variable number of proteins. We used four-layer stacks for the experiments in this publication, but have previously assembled stacks with up to ten layers and additional slices could be included if needed. The 3D arrays were secured to the top of a 6-well plate and after manually injecting the samples the device was centrifuged to pull the liquid through the channels. The speed and duration were adjusted for the different inlet designs to ensure that the entire sample passed through the nitrocellulose layers. Experiments performed with the 31 mm vertical channels were spun at 129×g for 12 min and with the angled channels at 201×g for 12 min. In the 18 mm vertical channels samples were either spun at 129×g for 6 min (FIG. 2C, constant concentration curve) or 453×g for 3 min (FIG. 2C, dilution series curve) after each injection step. After centrifugation, the layers were separated with tweezers and rinsed three times in TBS (1 ml, 10 min, gentle shaking). The microarrays were incubated in 150 μL of the detection antibody (5 μg/ml, 1 h, gentle shaking) and then rinsed three times with buffer (1 ml, 10 min) before imaging. The detection antibody was spiked into 1 mg/ml BSA to reduce nonspecific adsorption. For some experiments 0.5 mg/ml of goat IgG was additionally added, but this did not appear to improve the signal-to-noise and was removed from later experiments. The detection antibodies for TNF-α were biotinylated and needed an additional incubation in streptavidin Alexa Flour 488 (5 μg/ml, 30 min, gentle shaking) and rinsing before imaging.

Blood samples were prepared by diluting 5 μl of whole blood with 10 μl of PBS in an Eppendorf tube. The mixture was spun at 14 100×g for 3 min to sediment the red blood cells and any larger fragments which might clog the nitrocellulose. We removed 10 μl of the supernatant and injected it into the FoRe microarray channels. To simplify the experimental protocol some replicates were prepared by diluting 15 μl of blood with 30 μl of PBS and injecting 10 μl of supernatant into three different channels. Both approaches were employed to produce the dose response curve in FIG. 4 (i.e. the 3 replicates diluted individually or together), and there was no noticeable difference. The assembled stack was centrifuged at 201×g for 12 min to pull the diluted plasma through the layers. This was followed by rinsing and incubation in the detection antibody, as described above. The slices were then clamped between two microscopy slides to flatten them for automated imaging with a confocal laser scanning microscope (please see ESI for details on imaging and data analysis).

Imaging and Data Analysis

Fluorescence images were taken with a Zeiss LSM 510 confocal laser scanning microscope. The nitrocellulose layers were imaged individually in TBS; the slices were clamped between two microscopy slides to flatten them for automated imaging. Individual images were taken of each spot using a 10×EC Plan Neofluar objective (N.A. 0,3, open pinhole). The microscope settings were kept constant to image all spots in a given array. The fluorescence images were analyzed with MATLAB (The Mathworks Inc.) and ImageJ (Rasband, W., National Institute of Health).

The signal was calculated from the mean intensity of a circular area, 200 μm in diameter, centered over the fluorescent spot. The background was the average signal from at least three negative control spots (0 pM of the antigen), where the intensity of each spot is the mean of the circular area. The signal-to-background for the volume dependency experiments was calculated by dividing the average signal from three replicates by the average of the negative controls. For all other experiments we additionally performed unity-based normalisation; we subtracted the average intensity of the negative control from the signal and divided by the difference between the average maximum for that experiment and the average negative control. For the dose response curves all spots from the experimental repeats were averaged before performing normalisation.

| List of reference numerals | |
|---|---|
| 1 | Device for analysing liquid samples |
| 111 | Sample layer |
| 112 | Test site |
| 113 | Barrier region |
| 114 | Sample channel |
| 115 | Top sample layer |
| 116 | Second sample layer |
| 116a | Bottom sample layer |
| 117a | Upper sealing part |
| 117b | Lower sealing part |
| 118 | Bottom plate |
| 119 | Stack of sample layers |
| 120 | Frame |
| 121 | Clamp or spring-loaded tension lock |
| 122a | Upper sealing part opening |
| 122b | Lower sealing part opening |
| 123 | Outlet |
| 2 | Inlet part |
| 211 | Inlet channel |
| 212 | Reservoir section |
| 213 | Connecting section |
| 214 | Top plate |
| 215 | Reservoir part |
| 216 | Connecting part |
| 217 | Top plate opening |
| 218 | First opening |
| 219 | Second opening |
| 220 | Angled section |
| 221 | Transition section |
| 3 | Separation membrane |
| 4 | Hydrophobic membrane |
| 411 | Hole |
| 5 | Air passage |
| 511 | First air passage |
| 512 | Second air passage |
| 6 | Optical unit |
| 611 | Light source |
| 612 | First optical fibre |
| 613 | Second optical fibre |
| 614 | Photo detector |
| w | Width |
| h | Height |
| α | Angle |
| $d_1$ | First diameter |
| $d_2$ | Second diameter |
| p | Plane |
| $p_1$ | First plane |
| $p_2$ | Second plane |
| $D_1$ | First centre-to-centre distance |
| $D_2$ | Second centre-to-centre distance |

The invention claimed is:

1. A device (1) for analysing liquid samples, wherein the device (1) comprises at least one sample layer (111) comprising a plurality of liquid permeable test sites (112) separated from each other by a liquid impermeable barrier region (113), wherein said device (1) comprises an inlet part (2), wherein said inlet part (2) comprises a plurality of inlet channels (211), and wherein said inlet channels (211) lead to respective test sites (112) of said at least one sample layer (111), such that a flow connection between said inlet channels (211) and said respective test sites (112) is established or can be established, wherein said inlet channels (211) comprise first openings (218), which are positioned in a first plane ($p_1$), wherein said first openings (218) are accessible from the outside of said inlet part (2), such that liquid samples are loadable into said inlet channels (211) by means of said first openings (218), and wherein said inlet channels (211) comprise second openings (219), which are positioned in a second plane ($p_2$) adjacent to said test sites (112), such that liquid samples can flow from said inlet channels (211) to respective test sites (112) via said second openings (219), characterised in that a first surface area is defined by the positions of the first openings (218) in said first plane ($p_1$), and a second surface area is defined by the positions of said second openings (219) in said second plane ($p_2$), wherein said second surface area is smaller than said first surface area, and in that at least one of said inlet channels comprises an angled section, wherein said angled section is arranged at an angle of 5° to 89° with respect to a plane (p) defined by said at least one sample layer.

2. The device (1) according to claim 1, wherein the device (1) comprises at least a top sample layer (115) and a second sample layer (116), and wherein said top sample layer (115) and said second sample layer (116) are positioned such that the test sites (112) of said top sample layer (115) overlap with respective test sites (112) of said second sample layer (116), such that a liquid permeable sample channel (114) extending through said top sample layer (115) and said second sample layer (116) is formed by the test sites (112).

3. The device (1) according to claim 1, wherein said angled section (220) is positioned at an angle ($\alpha$) of 5° to 50 with respect to the plane (p).

4. The device (1) according to claim 1, wherein said inlet channels (211) comprise a cylindrical reservoir section (212), a conical transition section (221) and a connecting section (213), wherein said conical transition section (221) connects said reservoir section (212) and said connecting section (213), and said connecting section (213) leads to a respective test site (112).

5. The device (1) according to claim 4, wherein said reservoir section (212) has a volume in the range of 10 μl to 1000 μl.

6. The device (1) according to claim 4, wherein said reservoir section (212) has a volume of 3 μl to 50 μl.

7. The device (1) according to one claim 4, wherein said reservoir section (212) comprises a first diameter ($d_1$ ), and said connecting section (213) comprises a second diameter ($d_2$), wherein the ratio between said first diameter ($d_1$ ) and said second diameter ($d_2$) is at least 2 to 1.

8. The device (1) according to claim 1, wherein neighbouring first openings (218) are arranged at a first centre-to-centre distance ($D_1$) with respect to each other in the first plane ($p_1$), and wherein neighbouring second openings (219) are arranged at a second centre-to-centre distance ($D_2$) with respect to each other in the second plane ($p_2$), and wherein the ratio between the minimal first centre-to-centre distance ($D_1$) and the minimal second centre-to-centre distance ($D_2$) is at least 3 to 2.

9. The device (1) according to claim 1, wherein said device (1) comprises a separation membrane (3), wherein the separation membrane (3) is positioned in at least one of said inlet channels (211).

10. The device (1) according to claim 1, wherein said inlet channel (211) comprises at least one air passage (5), which connects said inlet channel (211) to the exterior.

11. The device (1) according to claim 1, wherein said device (1) comprises an optical unit (6) adapted to provide excitation light to a fluorophore and/or to measure light emitted by a fluorophore.

12. A method for analysing liquid samples by means of the device (1) according to claim 1, comprising the steps of:

loading a liquid sample into a respective inlet channel (211) of said inlet part (2) in a loading step, passing said liquid sample through a respective test site (112) and/or sample channel (114), which is connected to said respective inlet channel (211), in an assay step, analysing substances bound to a sample layer (111) of the device (1) in an analysis step.

13. The method according to claim 12, wherein at least one of said liquid samples is a viscous sample having a dynamic viscosity of at least $3 \cdot 10^{-3}$ Pa·s, and wherein said viscous sample is diluted by a dilution factor in a dilution step prior to the loading step.

14. The method according to claim 13, wherein said viscous sample comprises a first component and a second component, and wherein said first component is separated from said second component in a separation step after said dilution step and prior to said loading step.

15. A method for functionalising a sample layer (111), comprising the steps of:

providing a sample layer (111), wherein said sample layer (111) comprises a plurality of liquid permeable test sites (112) separated by a liquid impermeable barrier region (113), providing a reagent configured to capture analytes in one or more liquid samples, which is able to bind to said test sites (112), providing an inlet part (2) comprising a plurality of inlet channels (211), wherein said inlet channels (211) comprise first openings (218), which are positioned in a first plane ($p_1$), wherein said first openings (218) are accessible from the outside of said inlet part (2), such that said one or more liquid samples are loadable into the inlet channels (211) by means of said first openings (218), and wherein said inlet channels (211) comprise second openings (219), which are positioned in a second plane ($p_2$), wherein a first surface area is defined by the positions of said first openings (218) in said first plane ($p_1$), and a second surface area is defined by the positions of said second openings (219) in said second plane ($p_2$), wherein the second surface area is smaller than the first surface area, assembling said inlet part (2) and said sample layer (111), such that said test sites (112) of said sample layer (111) are aligned with respective second openings (219), such that liquid samples can flow from said inlet channels (211) of said inlet part (2) to said respective test sites (112) via said second openings (219), loading said reagent into at least one inlet channel (211), and passing said reagent through said respective test site (112), which is in flow connection with said at least one inlet channel (211).

16. A kit for performing the steps of the method according to claim 15 comprising:

a sample layer (111), wherein the sample layer (111) comprises a plurality of liquid permeable test sites (112) separated by a liquid impermeable barrier region (113), a reagent, which is able to bind to said test sites (112) and an inlet part (2) comprising a plurality of inlet channels (211), wherein said inlet channels (211) lead to respective test sites (112) of said sample layer (111), such that a flow connection between said inlet channels (211) and said respective test sites (112) is established or can be established, wherein said inlet channels (211) comprise first openings (218), which are positioned in a first plane ($p_1$), wherein said first openings (218) are accessible from the outside of said inlet part (2), such that liquid samples are loadable into the inlet channels (211) by means of said first openings (218), and wherein said inlet channels (211) comprise second openings (219), which are positioned in a second plane ($p_2$), such that liquid samples can flow from said inlet channels (211) to respective test sites (112) via said second openings (219), wherein a first surface area is defined by the positions of said first openings (218) in said first plane ($p_1$), and a second surface area is defined by the positions of said second openings (219) in said second plane ($p_2$), wherein said second surface area is smaller than said first surface area.

17. The device (1) according to claim 1, wherein said angled section (220) is positioned at an angle of 10° to 45° with respect to the plane (p).

18. The device (1) according to claim 1, wherein the angled sections are arranged at different angles.

19. The device according to claim 18, wherein the angle increases from an outer inlet channel to the center of the inlet part.

* * * * *